US009940868B2

(12) United States Patent
Soniwal et al.

(10) Patent No.: US 9,940,868 B2
(45) Date of Patent: Apr. 10, 2018

(54) CONVERGENT MONOTONIC MATRIX FACTORIZATION BASED ENTIRE FRAME IMAGE PROCESSING

(71) Applicant: Indian Institute of Technology Kanpur, Kanpur (IN)

(72) Inventors: Yogesh Kumar Soniwal, Sujangari (IN); Venkatesh K Subramanian, Kanpur (IN); Amit Mitra, Kanpur (IN)

(73) Assignee: Indian Institute of Technology Kanpur, Uttar Pradesh (IN)

( * ) Notice: Subject to any disclaimer, the term of this patent is extended or adjusted under 35 U.S.C. 154(b) by 18 days.

(21) Appl. No.: 14/883,645

(22) Filed: Oct. 15, 2015

(65) Prior Publication Data

US 2016/0117977 A1 Apr. 28, 2016

(30) Foreign Application Priority Data

Oct. 24, 2014 (IN) ..... 3035/DEL/2014

(51) Int. Cl.
*G09G 3/20* (2006.01)
*G09G 3/3216* (2016.01)

(52) U.S. Cl.
CPC ..... *G09G 3/2096* (2013.01); *G09G 3/3216* (2013.01); *G09G 2310/0208* (2013.01)

(58) Field of Classification Search
CPC ..... G09G 3/2096; G09G 3/3216; G09G 2310/0208
See application file for complete search history.

(56) References Cited

U.S. PATENT DOCUMENTS 7,944,410 B2 5/2011 Smith et al.
7,953,682 B2 5/2011 Smith et al.
(Continued)

OTHER PUBLICATIONS

Berry, M. W., et al., "Algorithms and applications for approximate nonnegative matrix factorization," Computational Statistics & Data Analysis, vol. 52, No. 1, pp. 155-173 (Sep. 15, 2007).
(Continued)

*Primary Examiner* — Ke Xiao
*Assistant Examiner* — Kim-Thanh T Tran
(74) *Attorney, Agent, or Firm* — Turk IP Law, LLC

(57) ABSTRACT

Technologies are generally described for the display of images by employing monotonic matrix factorization and sub-frame approximation image integration. In some examples, drive signals for a display device may be generated by iteratively applying a monotonic non-negative matrix factorization (NNMF) process to source image data. A given iteration of the monotonic NNMF process may result in approximation image data, partial sum image data, and residue image data, some or all of which may be further processed via subsequent iterations of the monotonic NNMF process. A generated approximation image data may then be displayed during a sub-frame time interval by selective activation of multiple row and column drivers. A series of such displayed approximation image data may effectively correspond to the original source image. In particular, the monotonic NNMF process may allow the generation of non-negative residue image data without the use of element reduction.

21 Claims, 11 Drawing Sheets

(56) References Cited

U.S. PATENT DOCUMENTS

| | | | | |
|---|---|---|---|---|
| 2004/0052236 | A1* | 3/2004 | Hwang | H04B 1/71052 370/342 |
| 2004/0111457 | A1* | 6/2004 | Scholz | G06F 17/141 708/400 |
| 2008/0291122 | A1* | 11/2008 | Smith | G06F 17/16 345/55 |
| 2013/0127886 | A1* | 5/2013 | Subramanian | G09G 5/36 345/545 |

OTHER PUBLICATIONS

Eisenbrand, F., et al., "Multiline addressing by network flow," Algorithmica, vol. 53, No. 4, pp. 583-596 (Mar. 2009).

Fyfe, D., "Total Matrix Addressing for OLED Displays," 9th Annual DisplaySearch US FPD Conference, pp. 1-33 (Mar. 6-8, 2007).

Lee, D. D., and Seung, H.S.,"Algorithms for Non-negative Matrix Factorization," NIPS'00 Proceedings of the 13th International Conference on Neural Information Processing Systems, pp. 1-7 (Jan. 1, 2000).

* cited by examiner

CONVERGENT MONOTONIC MATRIX FACTORIZATION BASED ENTIRE FRAME IMAGE PROCESSING

CROSS-REFERENCE TO RELATED APPLICATION

The application claims priority under 35 U.S.C. § 119(a) of India Application No. 3035/DEL/2014, filed on Oct. 24, 2014. India Application No. 3035/DEL/2014 is hereby incorporated by reference in its entirety.

BACKGROUND

Unless otherwise indicated herein, the materials described in this section are not prior art to the claims in this application and are not admitted to be prior art by inclusion in this section.

Organic light-emitting diode (OLED) devices, also referred to as organic electroluminescent (EL) devices, may provide a number of advantages over other flat-panel display devices of earlier technology types. High light emission, relatively wide viewing angle, reduced device thickness, and reduced electrical power consumption may be examples of some of the potential advantages of OLED devices compared to, for example, liquid crystal displays (LCDs) using backlighting. Applications of OLED devices may include active-matrix image displays, passive-matrix image displays, and area-lighting devices such as, for example, selective desktop lighting.

SUMMARY

The present disclosure generally describes techniques to process source image data with a monotonic non-negative matrix factorization (NNMF) process to generate sub-frames with partial sum image data and residue image data. The sub-frame data can be utilized to activate multiple rows and columns of a display during a single sub-frame image interval, so that a complete image may be visually integrated over successive sub-frame images.

According to some examples, a method is described to generate drive signals for a display device to display a source image in response to receipt of source image data. The method may include applying a monotonic non-negative matrix factorization (NNMF) process to the source image data to generate approximation image data, partial sum image data, and residue image data. The monotonic NNMF process may include extending a block matrix selected from the source image data and determining at least one new factor based on the extended block matrix and one of an approximation image row vector and an approximation image column vector. The monotonic NNMF process may further include adding the at least one new factor to the other of the approximation image row vector and the approximation image column vector to form an extended approximation image vector and generating the residue image data based on the extended approximation image vector and one of the approximation image row vector and the approximation image column vector. The method may further include iteratively applying the monotonic NNMF process to the reside image data to generate subsequent approximation image data, subsequent partial sum image data, and subsequent residue image data until a specific criterion is satisfied, where each approximation image data corresponds to a sub-frame image. The method may further include partitioning a total frame time into one or more sub-frame times associated with each sub-frame image and sending, to the display device, the approximation image data and corresponding sub-frame time for each sub-frame image, where multiple row drivers and multiple column drivers of the display device are selectively activated based on the approximation image data and corresponding sub-frame time.

According to other examples, an apparatus to generate drive signals for a display device to display a source image in response to receipt of source image data. An example apparatus may include a memory configured to store instructions and source image data, a processor coupled to the memory and adapted to execute the instructions, which in response to execution configure the processor to perform or cause to be performed application of a monotonic non-negative matrix factorization (NNMF) process to the source image data to generate approximation image data, partial sum image data, and residue image data. The monotonic NNMF process may include extension of a block matrix selected from the source image data and determination of at least one new factor based on the extended block matrix and one of an approximation image row vector and an approximation image column vector. The monotonic NNMF process may further include addition of the at least one new factor to the other of the approximation image row vector and the approximation image column vector to form an extended approximation image vector and generation of the residue image data based on the extended approximation image vector and one of the approximation image row vector and the approximation image column vector. The processor may further perform or cause to be performed iterative application of the monotonic NNMF process to the reside image data to generate subsequent approximation image data, subsequent partial sum image data, and subsequent residue image data until a specific criterion is satisfied, where each approximation image data corresponds to a sub-frame image and is buffered at a display buffer, and an energy of each sub-frame is determined partially from multiple activated pixels for a corresponding sub-frame. The processor may further perform or cause to be performed partition of a total frame time into one or more sub-frame times associated with each sub-frame image. The display buffer may be configured to send multiple buffered approximation image data for each sub-frame image to the display device such that multiple row drivers and multiple column drivers for the display devices are selectively activated for a duration based on a corresponding sub-frame time.

According to further examples, a non-transitory computer-readable storage medium may store instructions to generate drive signals for a display device to display a source image in response to receipt of source image data. The instructions may include generating a separable non-negative matrix series representation (SNMSR) of the source image data by applying a monotonic non-negative matrix factorization (NNMF) process to the source image data to generate approximation image data, partial sum image data, and residue image data. The monotonic NNMF process may include extending a block matrix selected from the source image data and determining at least one new factor based on the extended block matrix and one of an approximation image row vector and an approximation image column vector. The monotonic NNMF process may further include adding the at least one new factor to the other of the approximation image row vector and the approximation image column vector to form an extended approximation image vector and generating the residue image data based on the extended approximation image vector and one of the approximation image row vector and the approximation image column vector. Generating the SNMSR may further include iteratively applying the monotonic NNMF process to the residue image data to generate subsequent approximation image data, subsequent partial sum image data, and subsequent residue image data, where each approximation image data corresponds to a sub-frame image. The instructions may further include truncating the SNMSR in response to satisfaction of a particular criterion, where an integration of the sub-frame images displayed over a complete frame interval effectively corresponds to the source image.

The foregoing summary is illustrative only and is not intended to be in any way limiting. In addition to the illustrative aspects, embodiments, and features described above, further aspects, embodiments, and features will become apparent by reference to the drawings and the following detailed description.

BRIEF DESCRIPTION OF THE DRAWINGS

The below described and other features of this disclosure will become more fully apparent from the following description and appended claims, taken in conjunction with the accompanying drawings. Understanding that these drawings depict only several embodiments in accordance with the disclosure and are, therefore, not to be considered limiting of its scope, the disclosure will be described with additional specificity and detail through use of the accompanying drawings, in which:

DETAILED DESCRIPTION

Figure 1:
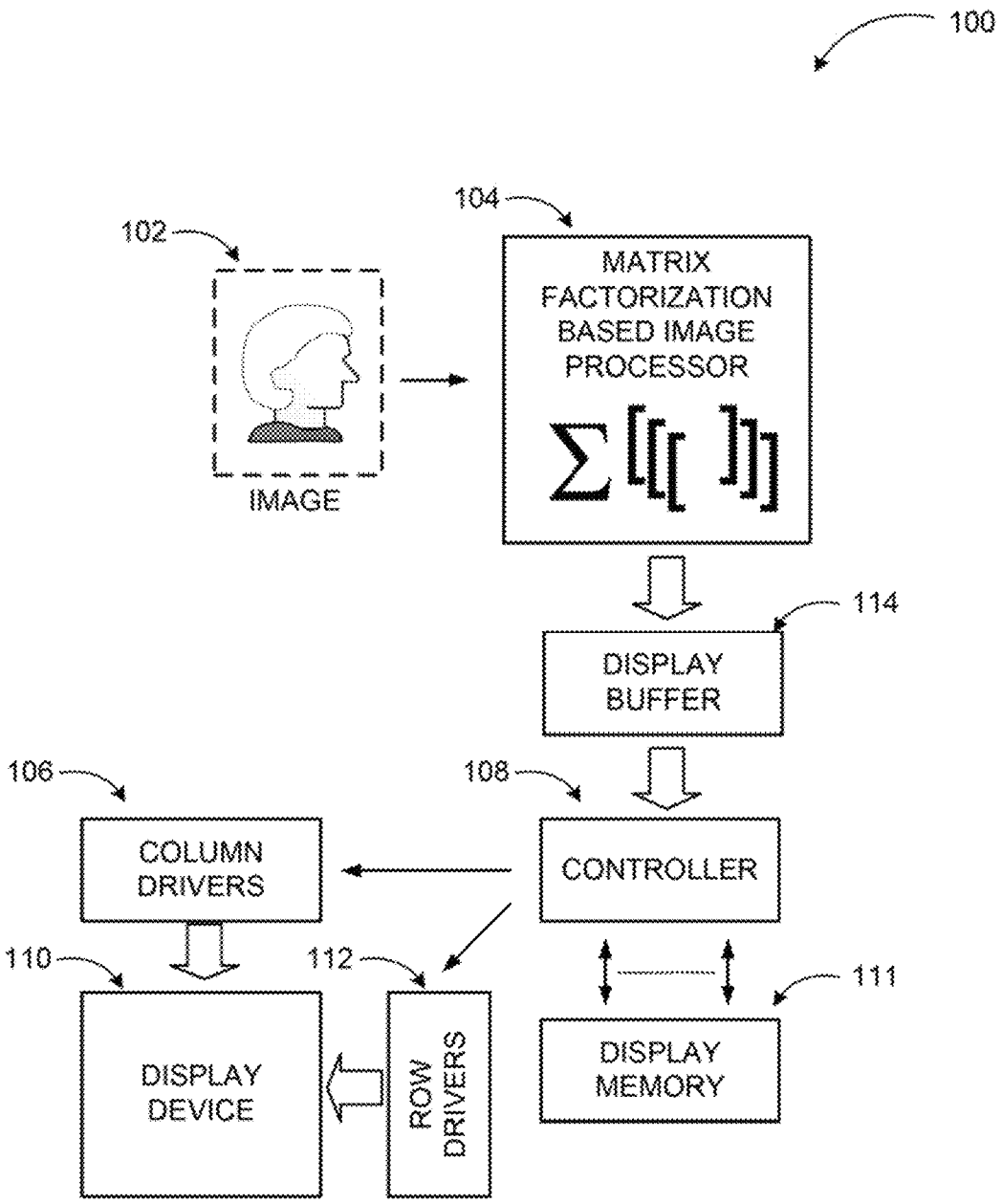
FIG. 1 illustrates a block diagram of example components in a matrix factorization based image processor system.

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented herein. The aspects of the present disclosure, as generally described herein, and illustrated in the Figures, can be arranged, substituted, combined, separated, and designed in a wide variety of different configurations, all of which are explicitly contemplated herein.

This disclosure is generally drawn, inter alia, to methods, apparatus, systems, devices, and/or computer program products related to display of images by employing monotonic matrix factorization and sub-frame approximation image integration.

Briefly stated, technologies are described for the display of images by employing monotonic matrix factorization and sub-frame approximation image integration. In some examples, drive signals for a display device may be generated by iteratively applying a monotonic non-negative matrix factorization (NNMF) process to source image data. A given iteration of the monotonic NNMF process may result in approximation image data, partial sum image data, and residue image data, some or all of which may be further processed via subsequent iterations of the monotonic NNMF process. A generated approximation image data may then be displayed during a sub-frame time interval by selective activation of multiple row and column drivers. A series of such displayed approximation image data may effectively correspond to the original source image. In particular, the monotonic NNMF process may allow the generation of non-negative residue image data without the use of element reduction.

In a system according to some embodiments, multiple elements of a rectangular display array (multiple rows and columns) may be activated simultaneously or at least substantially contemporaneously/simultaneously. Initially, a source image data matrix may be expressed as a convergent series of separable matrices, each term of which may be loaded at once into the array by exciting a plurality of horizontal and vertical lines together with appropriate values. In the context of OLED based display arrays, the use of matrix factorization may result in enhanced device lifetimes, reduced flicker, as well as enhanced display brightness and contrast. The final perceived display is the perceptually integrated sum of the terms in the series.

FIG. 1 illustrates a block diagram of example components in a matrix factorization based image processor system 100, arranged in accordance with at least some embodiments described herein. The various components may be operatively coupled to each other.

The image processor system 100 may include an image processor 104 configured to receive source image data corresponding to a source image 102. The image processor 104 may also be configured to generate and provide image data based on the source image 102 to a display buffer 114, which in turn may be configured to send the image data to a controller 108. The controller 108 may be configured to selectively activate column drivers 106 and/or row drivers 112 based on the image data in order to display the source image 102 or an image similar to the source image 102 (or portion thereof) on a display device 110. In some embodiments, the controller 108 may be configured to temporarily store and/or retrieve the image data to and from a display memory 111, which can comprise a part of the display device 110 in one embodiment. In some embodiments, the display buffer 114 may be part of the display device 110.

In some embodiments, the image processor 104 may be configured to generate image data based on the source image 102 by generating an SNMSR of data corresponding to the source image 102. The image processor 104 may generate a separable non-negative matrix series representation (SNMSR) by iteratively applying a monotonic non-negative matrix factorization (NNMF) process to the source image data to generate approximation image data, partial sum image data and residue image data. The image processor 104 may be configured to send the approximation image data to the display buffer 114 for subsequent forwarding to the controller 108 for display on display device 110.

Figure 2:
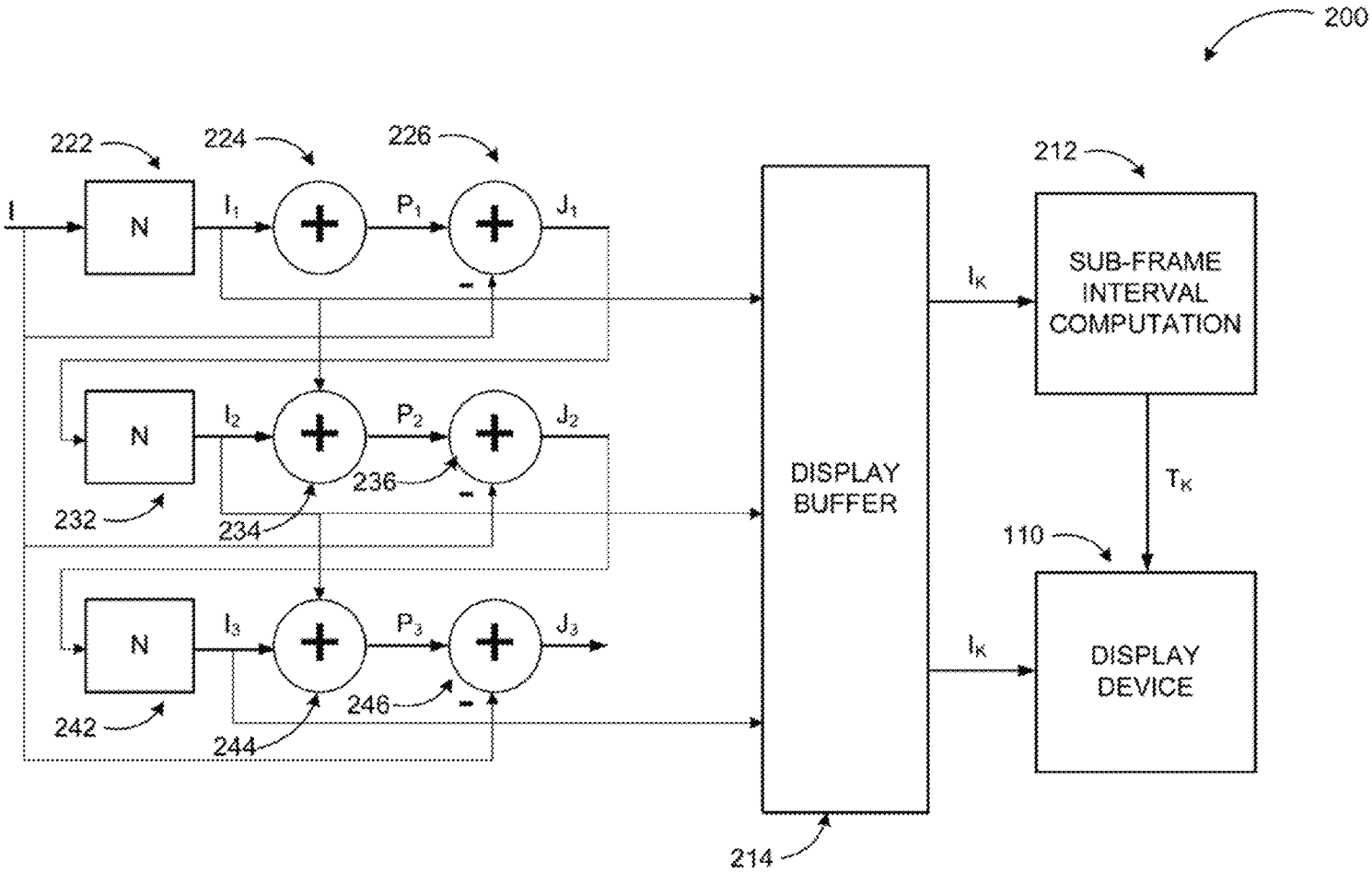
FIG. 2 illustrates an example implementation of an algorithm to generate partial sum images as a residue image converges to a threshold.

FIG. 2 illustrates an example implementation of an algorithm to generate partial sum images as a residue image converges to a threshold, which is usable in the image processor system 100 of FIG. 1 in accordance with at least some embodiments described herein.

Diagram 200 illustrates an example three-stage iterative NNMF process implementation for displaying a source image, where each iteration stage includes a processor block 222, 232, or 242 whose output terminal may be coupled to a display buffer 214 and to one or more of an adder 224, 234, or 244. The adders 224, 234, and 244 may have output terminals that are coupled to adders 226, 236, and 246. The adders 226, 236, and 246 may have output terminals coupled to the processor blocks 232, 242, and other processor blocks associated with any subsequent iteration stage(s). The display buffer 214 may be coupled to a sub-frame interval computation module 212. The display buffer 214 and the sub-frame interval computation module may both be coupled to or included in the display device 110.

In the diagram 200, I, J, and P may be input signals or variables that represent source image data, residue image data, and partial sum image data, respectively. Source image data I may be received as data that is represented as a matrix. The processor block 222 may be configured to perform monotonic NNMF on source image data I to generate a first approximation image data $I_1$. The processor block 222 may then output the first approximation image data $I_1$ to the adder 224 (in the first iteration stage), the adder 234 (in the second iteration stage), and the display buffer 214. For symmetry purposes, the first approximation image data $I_1$ may be coupled to an input terminal of the adder 224, but since the adder 224 may reside in the first iteration stage, no additional inputs to the adder 224 may exist. Accordingly, a first partial sum image data $P_1$ output from the adder 224 may be equivalent to the first approximation image data $I_1$ input into the adder 224.

The adder 224 may send the first partial sum image data $P_2$ to the adder 226, which may also receive as input the source image data I. The adder 226 may then subtract the first partial sum image data $P_1$ from the source image I and output a first residue image data $J_1$ to the processor block 232 in the second iteration stage. In some embodiments, some of the first partial sum image data $P_1$ may be larger than the corresponding data in the source image I, resulting in negative values in the first residue image data $J_1$. In these situations, the negative values in the first residue image data $J_1$ may be truncated or removed if subsequent NNMF is to be performed on the first residue image data $J_1$, because NNMF may not be able to be performed on negative data.

At the second iteration stage, the processor block 232 may perform monotonic NNMF on the first residue image data $J_1$, similar to the processor block 222, and output a second approximation image data $I_2$ to the adder 234, to the display buffer 214, and to the adder 244 in the third iteration stage. The adder 234 may then combine the second approximation image data $I_2$ and the first approximation image data $I_1$ received from the processor block 222 in the previous (first) iteration stage to form a second partial sum image data $P_2$. The adder 234 may then send the second partial sum image data $P_2$ to the adder 236, which may subtract the second partial sum image data $P_2$ from the source image data I to generate a second residue image data $J_2$, which may then be sent to the processor block 242 in the third iteration stage. As described above, if the second residue image data $J_2$ includes negative values, the negative values may be removed if subsequent NNMF is to be performed on the second residue image data $J_2$.

At the third iteration stage, the operations of the second iteration stage may be repeated using the processor block 242, the adder 244, and the adder 246, to result in a third approximation image data $I_3$, a third partial sum image data $P_3$, and a third residue image data $J_3$. The processor block 242, similar to the processor blocks 222 and 232, may be configured to send the third approximation image data $I_3$ to the display buffer 214.

At each iteration stage, a processor block or controller may evaluate the residue image data $J_k$ against a criterion and may terminate the iteration process if the criterion is satisfied resulting in a truncated series. In some embodiments, the criterion may include an energy fidelity threshold (whether the energy of the partial sum image data $P_k$ is sufficiently close to that of the source image data I) or a perceptual fidelity threshold (whether the partial sum image data $P_k$ appears sufficiently similar to the source image data I according to an observer). In some embodiments, the criterion may also be based on a time limitation (whether the iteration process exceeds a time duration), a buffer size limitation (whether the generated data exceeds a particular buffer size), an iteration limitation (whether the iteration process exceeds a particular number of iterations), or a frame count limitation (whether the frames generated by the iteration process exceeds a particular frame count). In some embodiments, the criterion may also include whether the monotonic NNMF process, described below in further detail, has generated an extended block matrix including all of the source image data I.

For a truncated series having, for example, K terms, the processor block or controller may evaluate the respective energies, $E_k$ (k=1, 2, . . . . . , K), for each sub-frame approximation image data, $I_k$ (k=1, 2, . . . , K) by, for example, comparison against a threshold as discussed above. The sub-frame interval computation module 212 may then determine a total available frame interval time T, and may partition the total available frame interval time T into non-overlapping sub-frame display times, $T_k$ (k=1, 2, . . . , K). In some embodiments, the sub-frame interval computation module 212 may perform the partition such that $E_1/T_1=E_2/T_2= \ldots =E_K/T_K$. Subsequently, the display buffer 214 may send all of the sub-frame approximation image data, $I_k$ (k=1, 2, . . . , K), stored in the display buffer 214 to the display device 110. At the same time, the sub-frame interval computation block 212 may send the determined sub-frame display times, $T_k$ (k=1, 2, . . . , K) to the display device 110. The display device 110 may then display the individual approximation images by selective activation of multiple row drivers (for example, the row drivers 112) and multiple column drivers (for example, the column drivers 106) for corresponding sub-frame display times (for example, $I_1$ for period $T_1$, $I_2$ for period $T_2$, . . . . $I_K$ for period $T_K$). In some embodiments, the display device 110 may be configured to cause all of the row drivers and all of the column drivers to be selectively activated for the duration $T_k$.

In some embodiments, each pixel device element in a display device such as the display device 110 may have two terminals, for example, a current input lead and a ground lead. At the current input lead, the current being fed to the pixel device may be controllable over a range of 0 units to L units. At the same time, for a diode of the pixel device to emit light, the ground lead may be an output lead that may be coupled to a circuit ground (e.g., for single-supply systems) for the current to flow through the pixel device. In a dual supply system, the ground may be a mid-supply, while circuitry of the pixel device may be disposed between a positive supply and a negative supply. Moreover, embodiments may also include a fully differential signal drive (not ground, but difference driven) circuit as opposed to a single-ended signal drive (ground-referenced) circuit. During a given frame interval time of T, the average intensity achieved by the pixel device may be expressed as a product of the average drive current ($I_D$) and the time ($t_D$) for which the output lead is grounded, divided by the total frame interval, $(I_D*t_D)/T$. Therefore, the bounds that could determine a range of possible average intensity of a single pixel device may be represented as $0<t_D<T$ and $0<I_D<L$.

In a display array displaying approximation image data, active rows may be driven during a frame interval while inactive rows are not driven during the same frame interval, based on the approximation image data. For example, in a single-supply system, the ground leads of a given row of pixels may be shorted together, to constitute a single row ground line (for example, an output line). Similarly, the input current leads of the pixels in a column may be shorted together to constitute a single column current line (for example, an input line) in a single-supply system. Comparable arrangements may be made in a differential system. The driving of the active rows, respectively, may minimize the total number of lines emanating from an M×N sized array, which may reduce the array from 2(M×N) to M+N. The device array may be controlled by M output lines and N input lines. To exclusively activate the (m, n)th pixel to an average intensity of $(I_D*t_D)/T$, input current $I_D$ may be applied on input line n while the output line m is simultaneously grounded for $t_D$, and all other output lines may be kept open and all other input lines may be kept at zero input. The other pixels in row 'm' may remain dark because their input lines (input lines other than n) are being kept at zero input. All the other pixels in the column 'n' may be dark because their output lines (output lines other than m) are being kept open.

If, based on approximation image data, two pixels (m, n), (m', n) in the same column are to be excited to two different intensities b and b', two time periods to and $t_D'$ may be found that satisfy $b=(I_D*t_D)/T$ and $b'=(I_D*t_D')/T$. The current $I_D$ may then be applied to input line n, while keeping output lines m, m'inactive for periods $t_D$ and $t_D'$, respectively. As before, output lines other than m, m' may be open and input lines other than n may have zero input. Similarly, if two pixels (m, n) (m, n') in the same row are to be excited to two different intensities b and b', two drive currents $I_D$ and $I_D'$ may be found that satisfy $b=(I_D*t_D)/T$ and $b'=(I_D*t_D)/T$. The drive currents $I_D$ and $I_D'$ may then be applied to columns n, n'while the output line m is left inactive for time $t_D$.

Such an approach may be implemented to handle any number of pixels confined to a common row or to a common column. In some embodiments, the above approach may be used if the intensity values in the different rows and/or different columns are linearly dependent, which may be indicated when the rank of the matrix of $I_D*t_D$ entries of the array is unity.

An arbitrary source image data I to be displayed on the array of pixels on a display may or may not have an image matrix of rank unity. If the image matrix to be displayed is of unit rank, then the image matrix may be displayed as-is, without further decomposition into multiple sub-frames. Accordingly, matrix factorization for an image matrix of unit rank may be completed in one sub-frame and the entire frame time interval may become available for displaying the image provided in one sub-frame, resulting in the image having M times greater average intensity.

Displaying unit rank image matrices according to the present disclosure may be further extended with respect to arbitrary images of possibly full rank. The possibility of encountering only unit rank images being remote, the algorithm may be implemented further for an arbitrary image by representing the image as the limit of a series of unit rank images. When considered as a matrix, an image may be given a rank of unity to enable application of a solution. Also, an M×N sized source image matrix, $I_M$, of rank unity may be expressed as the outer product of two matrices: $I_M=W\times H$, where W has dimension M×1 and H has dimension 1×N.

Each unit rank member of the series may represent an image that may be expressed as the outer product of a column with a row, but no partial sum of the members of the series may necessarily share this property of being unit rank. The gray scale images, as well as the individual channel components of a color image, may exhibit the property of being nonnegative. The components may be constrained including the partial sums of the representation to possess the property of non-negativity.

A separable non-negative matrix series representation (SNMSR) process may yield a series representation of an arbitrary image in terms of separable images. Each member of the series may then be subjected to monotonic non-negative matrix factorization (NNMF) to yield respective column and row factors.

In some embodiments, a substantial portion of the energy in the series representation may be confined to the first few terms of the series. The energy as used herein may refer to a sum of the square values of respective currents for each pixel element (In) in displaying a source image I. For an example implementation of the present image processor system 100, an energy threshold may be selected with an acceptable approximation error (defined as a difference between an ideal image and an integrated image viewed by the user), and the series may be truncated at an appropriate point to yield a 'finite' series. More generally, a more appropriate fidelity measure than one defined exclusively in terms of error energy may be used to determine the truncation point of the series approximation. For example, there are many perceptual error measures that may be used to determine the number of initial terms in the series representation to be retained. Each term in the series is a unit rank (separable) image data that contributes, along with the others, to yield a close approximation of the overall non-separable image. In one frame interval time of T, each member of the truncated series may be displayed once, and each such matrix may be considered as a sub-frame representation of the source image I.

However, it may not be necessary for all the sub-frames that make up a frame be allocated an equal share of the frame interval time T. For the SNMSR process, the source image matrix may be expressed as:

$$I_M=\Sigma_{k=1}^{\infty}I_k, \quad [1]$$

where $I_k=H_k$, $W_k$ is an M×1 column vector with a height of M elements and a width of 1 element, and $H_k$ is a 1×N row vector with a height of 1 element and a width of N elements, for all k. The value k may represent each sub-frame, for example, k=1 may represent the first sub-frame, k=2 may represent the second sub-frame, etc. Each $I_k$ may be called a sub-frame and a partial approximation sequence $P_k$ may be further defined based on $I_k$ as:

$$P_k=\Sigma_{j=1}^{k}I_j. \quad [2]$$

If $<I_k>$ is a converging series, $<P_k>$ may be a converging sequence. Monotonic nonnegative matrix factorization may be applied on $I_k$ as $I_k \rightarrow W_1 \times H_1 = I_1 = P_1$; $I - P_1 \rightarrow W_2 \times H_2 = I_2$; $P_2 = P_1 + I_2$; $I - P_2 \rightarrow W_3 \times H_3 = P_3 = P_2 + I_3$; and so on. $I_1$ may be equivalent to $P_1$ which is a first partial approximation, $P_2 = I_1 + I_2 = P_1 + I_2$; $P_3 = I_1 + I_2 + I_3 = P_2 + I_3$; and so on. The energy of $k^{th}$ sub-frame ($I_k$), $E_k$, may be expressed as:

$$E(I_k)=\Sigma_m\Sigma_n I_k^2(m,n), \quad [3]$$

where m and n are dimensions of the source image matrix $I_M$ whose individual elements $I_k$ correspond to the respective currents $I_D$ for each pixel element. The individual elements $I_k$ may be squared and summed to determine the total energy for displaying the image.

The process depicted in FIG. 2 may represent a single channel process such as may be utilized in a monochrome display. The same process can be applied in multiple channels, where each channel may represent a separate color plane (e.g., R. G, B, etc.), and each color plane may have a substantially similar arrangement to the single-channel example shown in FIG. 2. The single channel example implementation may be employed in displaying monochrome images. Multiple channels, each implementing the same or similar process, may be used for color images.

Figure 3:
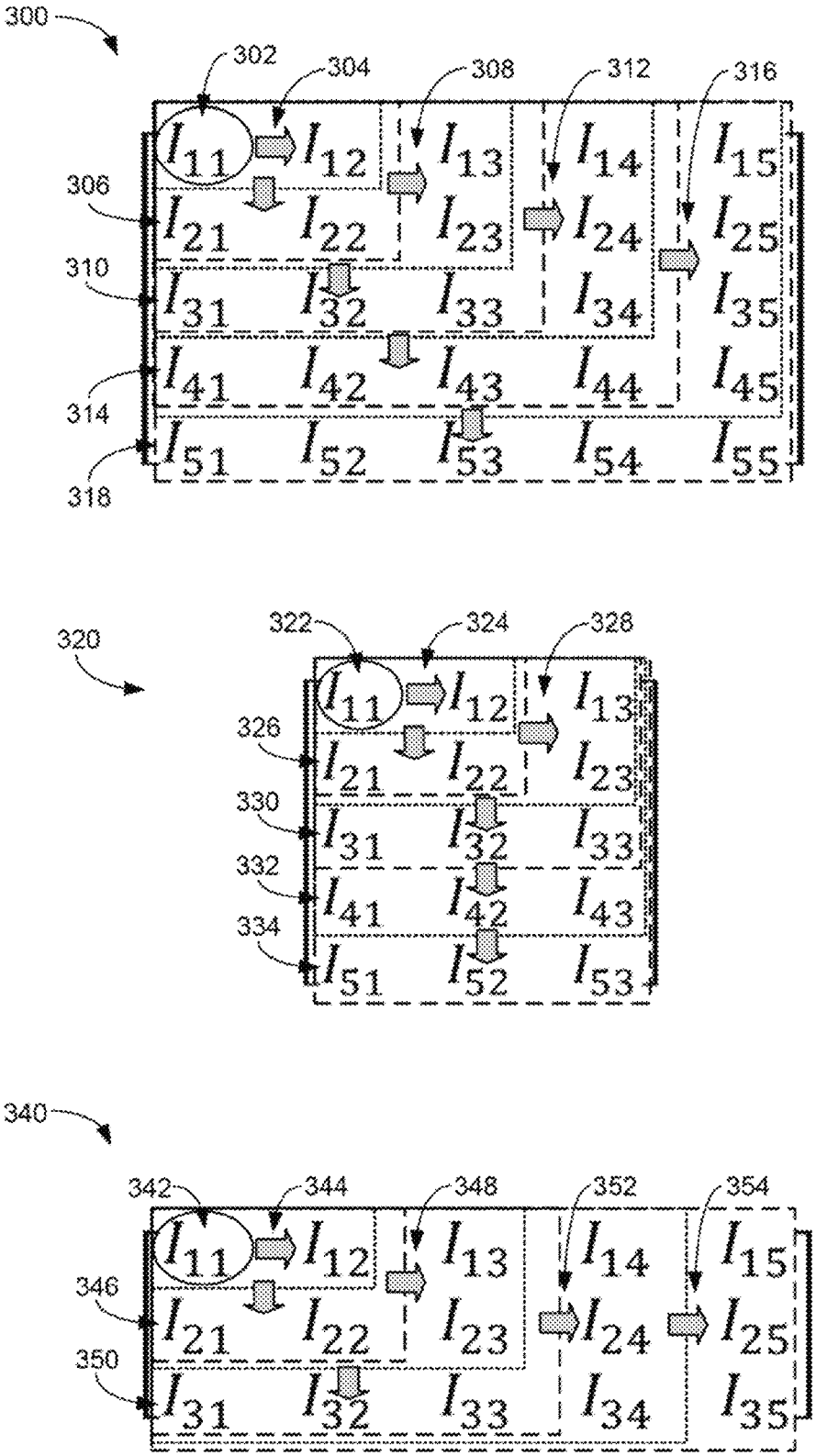
FIG. 3 illustrates examples of how source image data matrices may be processed using monotonic non-negative matrix factorization.

FIG. 3 illustrates examples of how source image data matrices may be processed using monotonic non-negative matrix factorization, arranged in accordance with at least some embodiments described herein.

As described above, an image processor (for example, the image processor 104) may perform a monotonic NNMF process to generate approximation image data associated with source image data. In particular, the monotonic NNMF process may generate an approximate image row vector and an approximate image column vector that when multiplied together for approximation image data. For example, the approximate image row vector may be similar to the matrix $W_k$ as described above, the approximate image column vector may be similar to the matrix $H_k$ as described above, and the approximation image data may be similar to the matrix $I_k$ as described above.

Non-monotonic NNMF processes may generate approximation image data whose elements may be larger than corresponding residue image data. Accordingly, subtraction of approximation image data generated using non-monotonic NNMF processes from the corresponding residue image data may result in negative elements in subsequent residue image data. Negative elements in residue image data may be problematic because they may prevent the use of subsequent NNMF processes and may lead to image distortion, thereby possibly involving subsequent truncation and processing operations.

A monotonic NNMF process, in contrast, may generate approximation image data whose elements are not larger than corresponding residue image data. Accordingly, subtraction of the approximation image data from the corresponding residue image data may not result in negative elements in subsequent residue image data, thereby possibly allowing subsequent use of NNMF processes and avoiding additional processing.

FIG. 3 depicts how a monotonic NNMF process may be used to generate approximate image row and column vectors from a source image matrix 300. The source matrix 300 may be depicted as a 5×5 matrix of elements. Each element may be denoted as $I_{mn}$, where m represents the vertical position of the element in the matrix and n represents the horizontal position of the element in the matrix. The monotonic NNMF process may begin with the selection of a starting position and a corresponding starting approximation image value. In the matrix 300, the starting position may be the top leftmost element $I_{11}$. The corresponding starting approximation image value may be selected as a random value between zero and the value of the element $I_{11}$. For the matrix 300, the starting approximation image value may be the first column element, referred to as $h_1$, in an approximate image column vector.

A first block matrix 302 may then be selected from the matrix 300. In some embodiments, the block matrix may be an extended version of a previous block matrix, and may include any elements in the matrix 300 previously in a block matrix. Since the block matrix 302 is the first block matrix, the block matrix 302 may include only the starting position element $I_{11}$.

A first row element $w_1$ in the approximate image row vector may then be generated based on the element $I_{11}$ and the previously determined first column element $h_1$ in the approximate image column vector such that $$w_1 = \frac{I_{11}}{h_1}.$$

This determination of $w_1$ may assure that the approximation image data element formed by multiplying $w_1$ and $h_1$ is not greater than $I_{11}$ and therefore may not result in a subsequent residue element value that is negative.

Subsequently, a block matrix 304 may be formed by extending the block matrix 302 to include an additional element $I_{12}$ in addition to the first element $I_{11}$. A second column element $h_2$ in the approximate image column vector may then be generated based on the element $I_{12}$ and the previously determined row element $w_1$. In particular, the equation used to generate the second column element $h_2$ may be $$h_2 = \frac{I_{12}}{w_1},$$

which may be similar in form to the equation used to generate the first row element $w_1$ above. This equation may assure that the approximation image data element formed by multiplying $w_1$ and $h_2$ is not greater than $I_{12}$ and therefore may not result in a subsequent residue element value that is negative.

A block matrix 306 may then be formed by extending the block matrix 304 to include two additional elements $I_{21}$ and $I_{22}$. A second row element $w_2$ in the approximate image row vector may then be generated based on the second column element $h_2$ and the new elements $I_{12}$ and $I_{12}$. Specifically, an intermediate result containing two potential row element values $$\left\{\frac{I_{21}}{h_1}, \frac{I_{22}}{h_2}\right\}$$

may be generated using the second column element $h_2$ and the new elements $I_{12}$ and $I_{12}$, and $w_2$ may be selected as the minimum value from the intermediate result. This may assure that the approximation image data elements formed by multiplying $w_2$ and $h_1$ or $h_2$ is not greater than $I_{21}$ or $I_{22}$ and therefore may not result in a subsequent residue element value that is negative.

Subsequently, block matrices 308, 310, 312, 314, 316, and 318 may be formed by continuing to extend the block matrix 306 in alternating horizontal and vertical directions until the final block matrix 318 includes all the elements in the matrix 300. The appropriate row or column elements in the approximate image row or column vector may be generated for each of the block matrices 308-318 in the same manner as described above.

In cases where the image matrix is not square, the block matrix extension process may alternate until a boundary is reached, at which point the block matrix extension process may continue along the direction in which unprocessed image matrix elements exist. For example, a tall image matrix 320 may initially have block matrices 322, 324, 326, 328, and 330 that alternate between horizontal and vertical directions. After the elements of the block matrix 330 have been processed as described above, block matrices 332 and 334 may be formed by continuing to extend the block matrix 330 in a vertical direction until all elements in the matrix 320 have been included in a block matrix. Similarly, a stout matrix 340 may initially have block matrices 342, 344, 346, 348, 350, and 352 that alternate between horizontal and vertical directions. After the elements of the block matrix 352 have been processed as described above, a block matrix 354 may be formed by continuing to extend the block matrix 352 horizontally until all elements in the matrix 340 have been included.

While the top leftmost element $I_{11}$ is used as the starting position in the examples above, other elements in an image matrix may be used as the starting position in other embodiments. For example, an element in a different corner (top rightmost, bottom leftmost, bottom rightmost) of the image matrix may be used. As another example, an element at the midpoint of a horizontal or vertical side of the image matrix may be used. As yet another example, a random element anywhere within the image matrix may be used. In the latter two examples, block matrix extension may occur in alternating in direction in addition to horizontal and vertical orientation. For example, a first block matrix extension may be rightward by one column, a second block matrix extension may be upward by one row, a third block matrix extension may be leftward by one column, and a fourth block matrix extension may be downward by one row. In other embodiments, block matrix extension sequences may include any suitable combination of direction and/or orientation.

Figure 4:
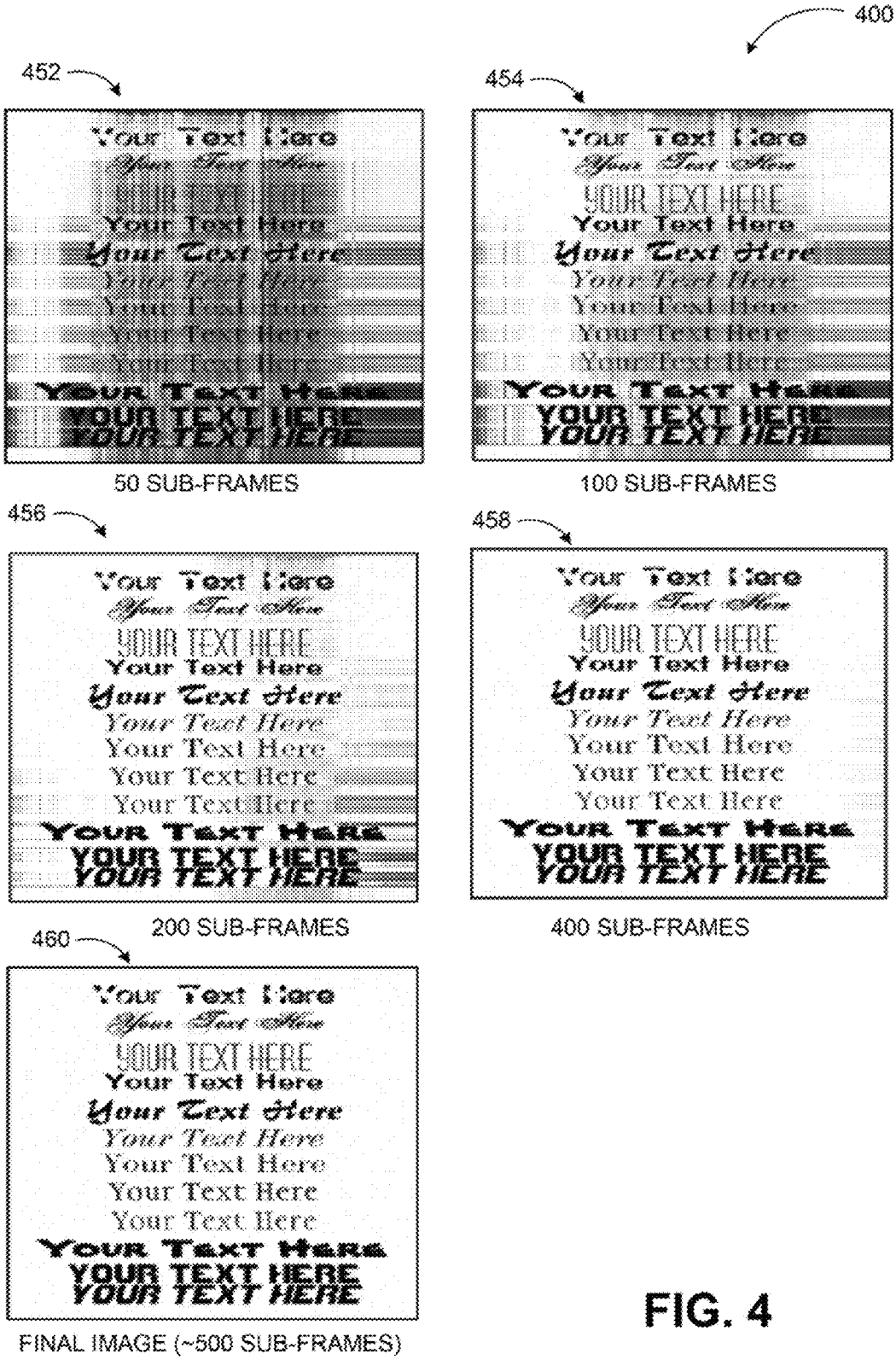
FIG. 4 illustrates example partial sum images created from a source image by employing monotonic NNMF.

FIG. 4 illustrates example partial sum images created from a source image by employing monotonic NNMF, arranged in accordance with at least some embodiments described herein.

Diagram 400 illustrates examples of the changes in an example image that includes various sizes and fonts styles of black and white text as the image is processed iteratively by applying monotonic NNMF and generating approximation images, which are displayed on a display device at each sub-frame interval and integrated by the human eye over a complete frame interval. The same or similar processes may be applied to other image types with various complexities of content, color, contrast, etc. as well using the principles described herein.

As discussed in more detail below, a large portion the percentage energy of the displayed image (e.g., 90%) may be covered after about 400 approximation images. Furthermore, energy based partial approximation error may also converge relatively rapidly depending on image complexity, number of colors, etc. The example iteration results (approximation images 452, 454, 456, 458, and 460) corresponding to 50, 100, 200, 400, and approximately 500 sub-frames (or iterations) show the improvement in the quality of the approximation image as the number of iterations increases. The approximation error for the simpler types of images may converge very rapidly. As shown in the diagram 400, an approximation image 454 (after 100 iterations) may be quite legible, although the approximation image 454 may have some image quality issues, such as the horizontal and vertical shading stripes.

A difference between the approximation images 458 and 460 may be almost imperceptible, which may indicate that the partial approximation error has reached a sufficiently low level at the 400th iteration. Accordingly, in some embodiments, the iterative process may be terminated at that iteration. Early termination may reduce computational resource usage as well as increase a display device's mean lifetime by reducing the number of activations of the row and column elements.

Figure 5:
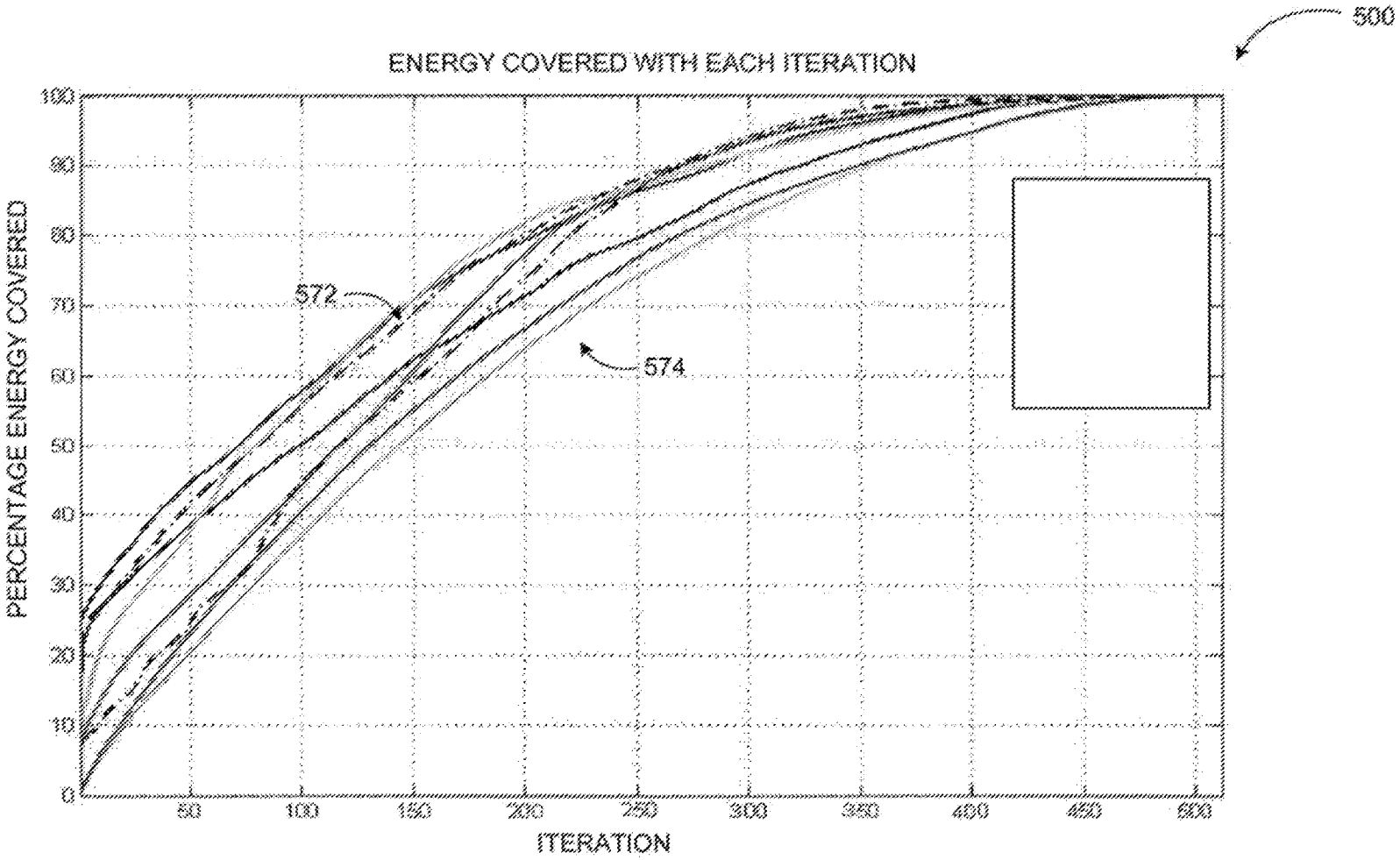
FIG. 5 illustrates a diagram of example energy covered with each iteration using approximation images.

FIG. 5 illustrates a diagram 500 of example energy covered with each iteration using approximation images, arranged in accordance with at least some embodiments described herein.

In diagram 500, the horizontal axis represents the number of iterations and the vertical axis represents the percentage energy covered for each iteration, where the percentage energy refers to the portion of energy contained in a sub-frame as compared to the total energy that a complete image contains. The energy of each sub-frame may be expressed as shown in equation [3] above, where the energy of each sub-frame may be determined by the sum of current terms squared associated with the activated pixels for the corresponding sub-frame. While the diagram 500 includes multiple energy percentage vs. iteration plots 574 for a variety of example images (varying complexity, color content, etc.) to illustrate similar pattern and convergence for different image types, plot 572 represents the iterations for the example image of FIG. 4.

As diagram 500 illustrates, the normalized (or percentage) energy of the sub-frames may converge rapidly during the first few iterations. In some embodiments, the first iteration may include approximately 90% of the total energy for the displayed image, as shown by the energy curve 576. As the energy levels may rapidly converge during the first few iterations and then assume a slowly decreasing pattern, the iterations may be terminated after 400 or so for convergence. Another consideration in determining the number of iterations to perform may be the partial approximation error discussed below.

Figure 6:
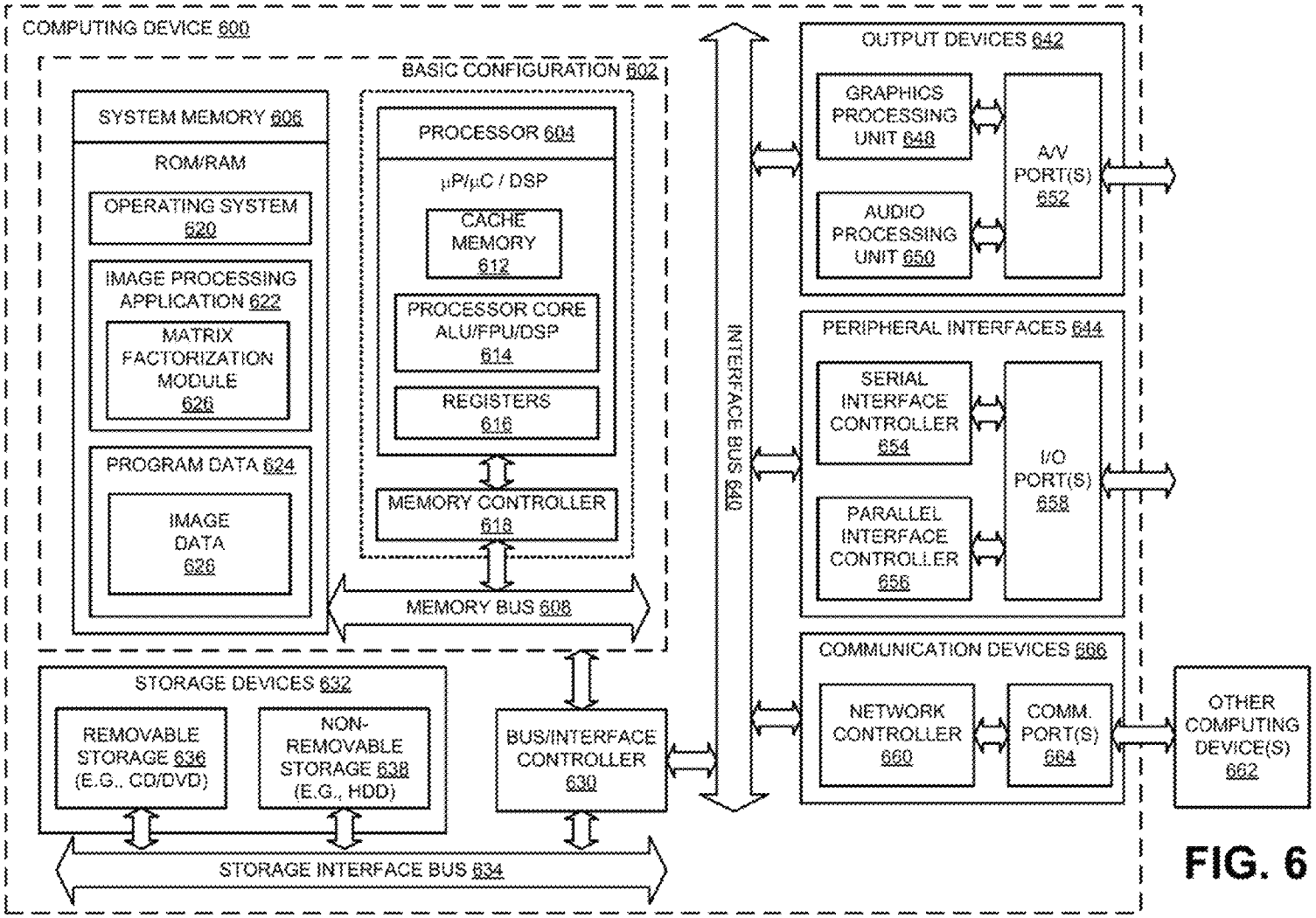
FIG. 6 illustrates a general purpose computing device, which may be used to implement matrix factorization based image processing by using partial sum images.

FIG. 6 illustrates a general purpose computing device, which may be used to implement matrix factorization based image processing by using partial sum images, arranged in accordance with at least some embodiments described herein.

For example, the computing device 600 may be used to perform image processing based on convergent monotonic matrix factorization as described herein. In an example basic configuration 602, the computing device 600 may include one or more processors 604 and a system memory 606. A memory bus 608 may be used to communicate between the processor 604 and the system memory 606. The basic configuration 602 is illustrated in FIG. 6 by those components within the inner dashed line.

Depending on the desired configuration, the processor 604 may be of any type, including but not limited to a microprocessor (μP), a microcontroller (μC), a digital signal processor (DSP), or any combination thereof. The processor 604 may include one or more levels of caching, such as a cache memory 612, a processor core 614, and registers 616. The example processor core 614 may include an arithmetic logic unit (ALU), a floating point unit (FPU), a digital signal processing core (DSP core), or any combination thereof. An example memory controller 618 may also be used with the processor 604, or in some implementations, the memory controller 618 may be an internal part of the processor 604. In some embodiments, the processor 604 may be configured to implement an image processor such as the image processor 104, alone or in conjunction with the system memory 606.

Depending on the desired configuration, the system memory 606 may be of any type including but not limited to volatile memory (such as RAM), non-volatile memory (such as ROM, flash memory, etc.) or any combination thereof. The system memory 606 may include an operating system 620, an image processing application 622, and program data 624. The image processing application 622 may be configured to be executed by an image processor such as the image processor 104, and may include a matrix factorization module 626 to implement convergent monotonic matrix factorization as described herein. The program data 624 may include, among other data, image data 628 or the like, as described herein. For example, image data 628 may store original image data such as the source image 102. In some embodiments, the system memory 606 may serve as a display buffer (for example, the display buffer 114) or a display memory (for example, the display memory 111).

The computing device 600 may have additional features or functionality, and additional interfaces to facilitate communications between the basic configuration 602 and any desired devices and interfaces. For example, a bus/interface controller 630 may be used to facilitate communications between the basic configuration 602 and one or more data storage devices 632 via a storage interface bus 634. The data storage devices 632 may be one or more removable storage devices 636, one or more non-removable storage devices 638, or a combination thereof. Examples of the removable storage and the non-removable storage devices include magnetic disk devices such as flexible disk drives and hard-disk drives (HDDs), optical disk drives such as compact disk (CD) drives or digital versatile disk (DVD) drives, solid state drives (SSDs), and tape drives to name a few. Example computer storage media may include volatile and nonvolatile, removable and non-removable media implemented in any method or technology for storage of information, such as computer readable instructions, data structures, program modules, or other data.

The system memory 606, the removable storage devices 636 and the non-removable storage devices 638 are examples of computer storage media. Computer storage media includes, but is not limited to, RAM, ROM, EEPROM, flash memory or other memory technology, CD-ROM, digital versatile disks (DVDs), solid state drives, or other optical storage, magnetic cassettes, magnetic tape, magnetic disk storage or other magnetic storage devices, or any other medium which may be used to store the desired information and which may be accessed by the computing device 600. Any such computer storage media may be part of the computing device 600.

The computing device 600 may also include an interface bus 640 for facilitating communication from various interface devices (e.g., one or more output devices 642, one or more peripheral interfaces 644, and one or more communication devices 666) to the basic configuration 602 via the bus/interface controller 630. Some of the example output devices 642 include a graphics processing unit 648 and an audio processing unit 650, which may be configured to communicate to various external devices such as a display (for example, the display device 110 of FIG. 1 and its associated column drivers 106 and row drivers 112) or speakers via one or more A/V ports 652. In some embodiments, the graphics processing unit 648 may be configured to implement an image processor such as the image processor 104 or a controller such as the controller 108. The graphics processing unit 648 may also include memory configured to implement a display buffer (for example, the display buffer 114) and/or a display memory (for example, the display memory 111). One or more example peripheral interfaces 644 may include a serial interface controller 654 or a parallel interface controller 656, which may be configured to communicate with external devices such as input devices (e.g., keyboard, mouse, pen, voice input device, touch input device, etc.) or other peripheral devices (e.g., printer, scanner, etc.) via one or more I/O ports 658. An example communication device 666 includes a network controller 660, which may be arranged to facilitate communications with one or more other computing devices 662 over a network communication link via one or more communication ports 664. The one or more other computing devices 662 may include servers at a datacenter, customer equipment, and comparable devices.

The network communication link may be one example of a communication media. Communication media may be embodied by computer readable instructions, data structures, program modules, or other data in a modulated data signal, such as a carrier wave or other transport mechanism, and may include any information delivery media. A "modulated data signal" may be a signal that has one or more of its characteristics set or changed in such a manner as to encode information in the signal. By way of example, and not limitation, communication media may include wired media such as a wired network or direct-wired connection, and wireless media such as acoustic, radio frequency (RF), microwave, infrared (IR) and other wireless media. The term computer readable media as used herein may include both storage media and communication media.

The computing device 600 may be implemented as a part of a general purpose or specialized server, mainframe, or similar computer that includes any of the above functions. The computing device 600 may also be implemented as a personal computer including both laptop computer and non-laptop computer configurations.

Figure 7:
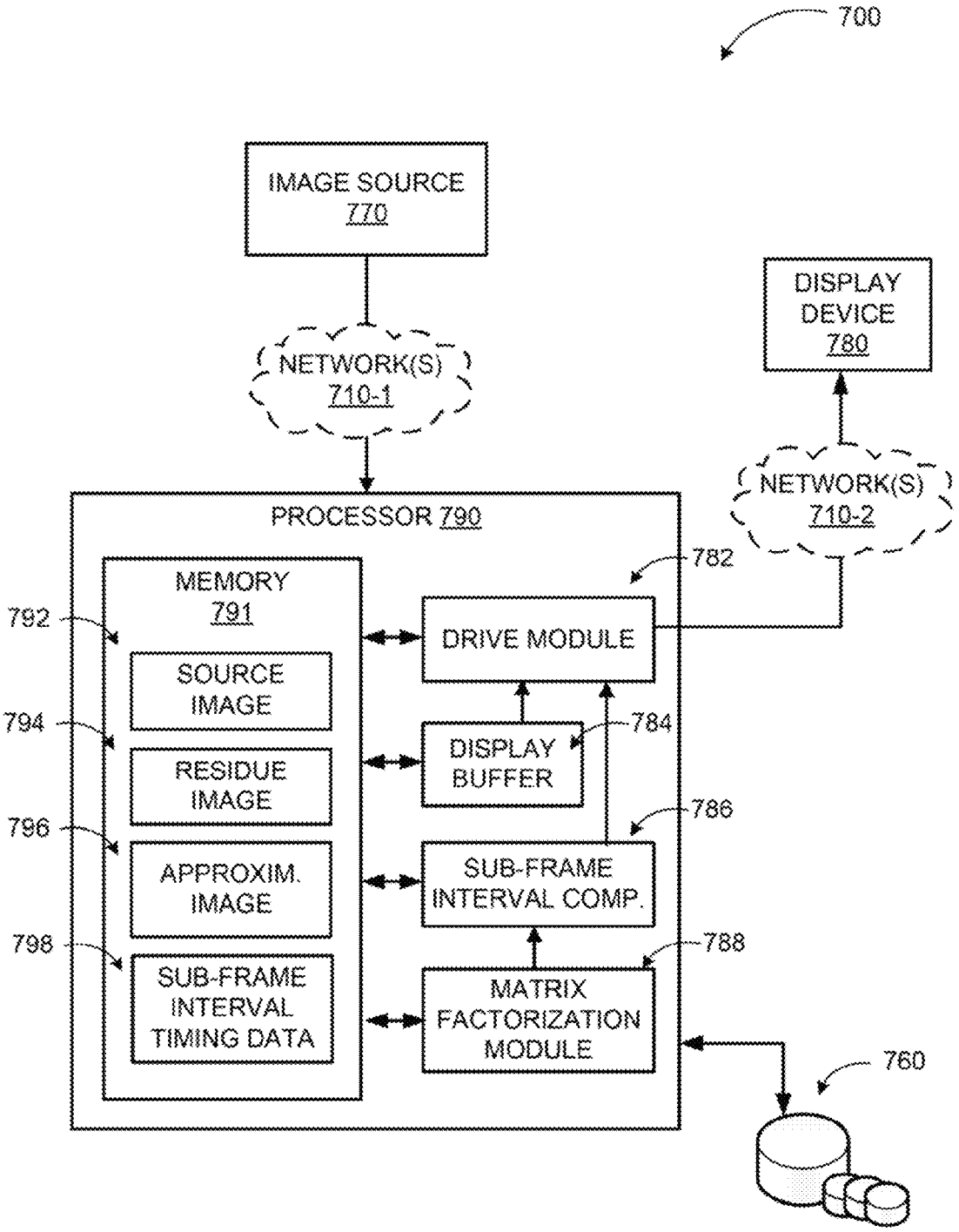
FIG. 7 illustrates a special purpose processor, which may be used to implement monotonic matrix factorization based image processing by using approximation images.

FIG. 7 illustrates a special purpose processor, which may be used to implement monotonic matrix factorization based image processing by using approximation images, arranged in accordance with at least some embodiments described herein.

According to a diagram 700, a processor 790 may be part of a computing device that is communicatively coupled to a display device 780 (which may be similar to the display device 110) through one or more network(s) 710-2, or may be embedded into the display device 780. The processor 790 may include a number of processing modules such as a matrix factorization module 788, a sub-frame interval computation module 786, a display buffer 784 (similar to the display buffer 114), and a drive module 782. In some embodiments, the matrix factorization module 788 may be configured to implement features/operations/functions of the matrix factorization-based image processor 104. In some example embodiments, one or more of a memory 791, the display buffer 784, and/or the drive module 782 may be external to the processor 790. An source image data 792 may be provided to the processor 790 from an image source 770 (for example, a camera, another computing device, a scanner, and comparable devices) directly or through one or more network(s) 710-1. The matrix factorization module 788 may be configured to use monotonic NNMF as described above to iteratively generate first and successive approximation image data 796 from the source image data 792 and subsequent residue image data 794. At each iteration, the residue image data 794 may be compared to a threshold, and the iteration may be terminated when the threshold is reached. In some embodiments, the generated approximation image data 796 may be stored in display buffer 784.

Ater completion of the iteration, the sub-frame interval computation module 786 may be configured to compute non-overlapping sub-frame interval timing data 798. The approximation image data 796 and the sub-frame interval timing data 798 may be sent from the display buffer 784 to a controller (for example, the controller 108) of the display device 780 by the drive module 782. In some embodiments, the drive module 782 itself may be configured to implement the controller 108, the column drivers 106, and/or the row drivers 112. The memory 791 may be configured to implement a display buffer such as the display buffer 114 and/or a display memory such as the display memory 111, and may store the source image data 792, the residue image data 794, the approximation image data 796, and the sub-frame interval timing data 798 during processing. In some embodiments, the memory 791 may be a cache memory of the processor 790 or an external memory (e.g., memory external to the processor 790). The processor 790 may also be communicatively coupled to one or more data stores 760, where at least some of the data may be stored during or following the processing of the source image.

Example embodiments may also include methods. These methods can be implemented in any number of ways, including the structures described herein. One such way of implementing a method is by machine operations, of devices of the type described in the present disclosure.

Figure 8:
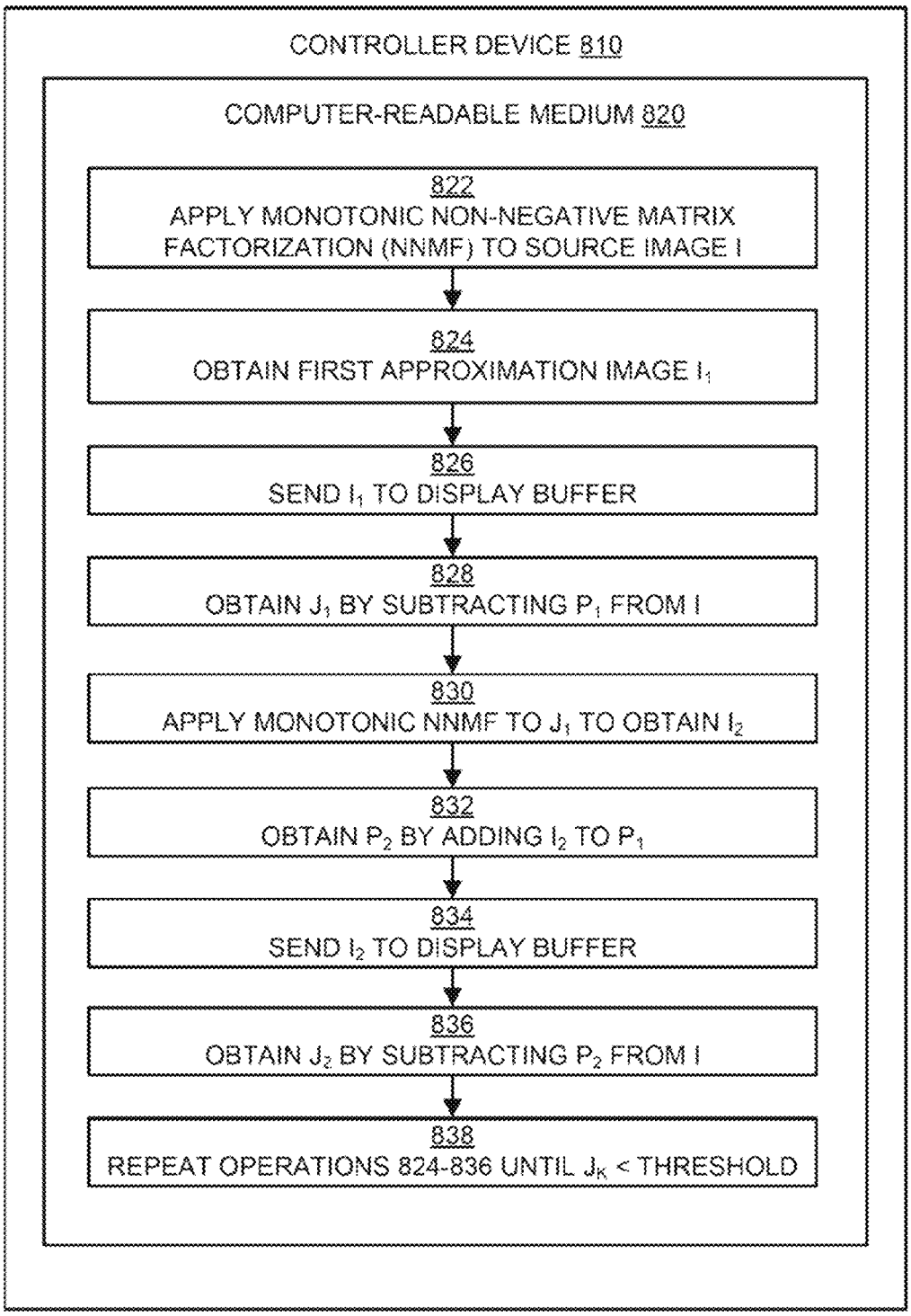
FIG. 8 is a flow diagram illustrating an example method for matrix factorization based image processing using approximation images that may be performed by a computing device such as the computing device in FIG. 6 or a special purpose processor such as the special purpose processor of FIG. 7.

FIG. 8 is a flow diagram illustrating an example method for matrix factorization based image processing using approximation images that may be performed by a computing device such as device 700 in FIG. 7 or a special purpose processor such as processor 790 of FIG. 7, arranged in accordance with at least some embodiments described herein.

The method may include one or more operations, functions, or actions as is illustrated by blocks 822, 824, 826, 828, 830, 832, 834, 836, and/or 838. Instructions that enable the performance of the operations described in blocks 822 through 838 may be stored as computer-executable instructions in a computer-readable medium 820 such as the data storage devices 632 of the computing device 600 illustrated in FIG. 6 and executed by a controller device 810 such as processor 604 of computing device 600 of FIG. 6.

A process of matrix factorization based image processing using partial sum images may begin with operation 822, "APPLY MONOTONIC NON-NEGATIVE MATRIX FACTORIZATION (NNMF) TO SOURCE IMAGE I." At operation 822, source image data, which may be represented as a separable non-negative matrix series, may be subjected to a monotonic NNMF process by an image processor (for example, the image processor 104 of FIG. 1) such that a partial sum image data $P_1$ is obtained. Operation 822 may be followed by operation 824. At operation 824, "OBTAIN FIRST APPROXIMATION IMAGE $I_1$", a first approximation image $I_1$ may be obtained by the processor. Operation 824 may be followed by operation 826. At operation 826, "SEND $I_1$ TO DISPLAY BUFFER," the first approximation image $I_1$ may be sent from the processor to a display buffer (for example, the display buffer 214) for display as described above.

Operation 826 may be followed by operation 828. At operation 828, "OBTAIN $J_1$ BY SUBTRACTING $P_1$ FROM I," the processor may obtain first residue image data $J_1$ by subtracting $P_1$ from I. Operation 828 may be followed by operation 830. At operation 830, "APPLY MONOTONIC NNMF TO $J_1$ TO OBTAIN $I_2$", the processor may apply the monotonic NNMF process again to first residue image data $J_1$ to obtain second approximation image data $I_2$. Operation 830 may be followed by operation 832. At operation 832, "OBTAIN $P_2$ BY ADDING $I_2$ TO $P_1$," the second partial sum image data $P_2$ may be obtained by adding the second approximation image data $I_2$ to the first partial sum image data $P_1$. The addition and subtraction operations may be performed using adders (e.g., the adders 224, 226) as shown in diagram 200 of FIG. 2. Operation 832 may be followed by operation 834. At operation 834, "SEND $I_2$ TO DISPLAY BUFFER," the second approximation image data $I_2$ may be sent from the processor to the display buffer for display as described above.

Operation 834 may be followed by operation 836. At operation 836. "OBTAIN $J_2$ BY SUBTRACTING $P_2$ FROM I," the processor may obtain second residue image data $J_2$ by subtracting $P_2$ from the original source image data I. Operation 836 may be followed by operation 838. As shown in operation 838, "REPEAT OPERATIONS 824-836 UNTIL $J_K$<THRESHOLD," the operations 824 through 836 may be repeated iteratively until a specific threshold is reached. The specific threshold may be an energy threshold representing a percentage error in the displayed source image. The iterations may be terminated and the series truncated when the specific threshold is reached. An integration of the sub-frame images displayed over a complete frame interval by the human eye effectively corresponds to the source image.

Figure 9:
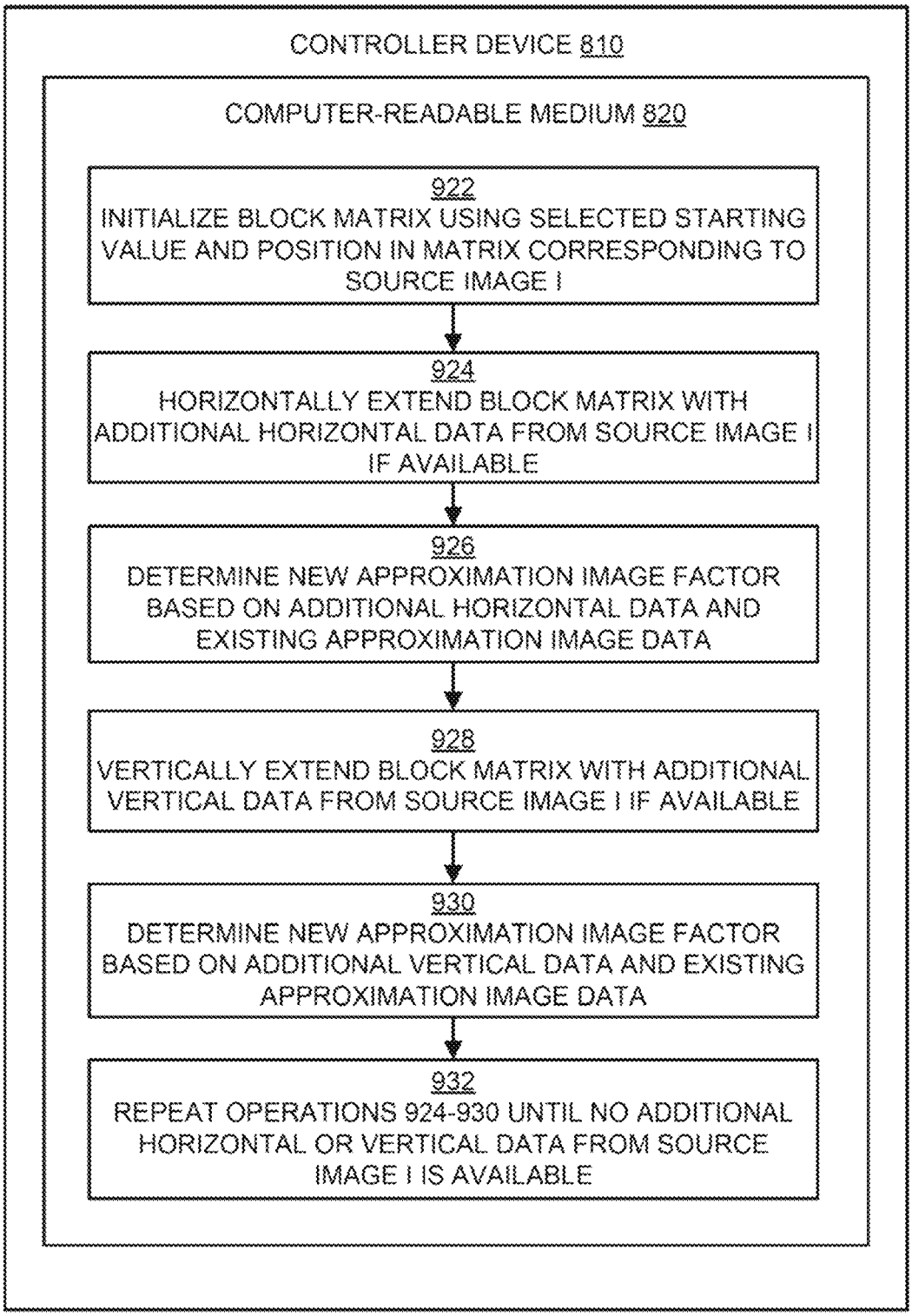
FIG. 9 is a flow diagram illustrating an example method for monotonic non-negative matrix factorization.

FIG. 9 is a flow diagram illustrating an example method for monotonic non-negative matrix factorization, arranged in accordance with at least some embodiments described herein.

The method may include one or more operations, functions, or actions as is illustrated by blocks 922, 924, 926, 928, 930, and/or 932. Instructions that enable the operations described in blocks 922 through 932 may also be stored as computer-executable instructions in a computer-readable medium 820 such as data storage devices 632 of the computing device 600 illustrated in FIG. 6 and executed by a controller device 810 such as processor 604 of computing device 600 of FIG. 6.

The process of FIG. 9 may be executed at operations 822 and/or 830 of FIG. 8, and may begin with operation 922, "INITIALIZE BLOCK MATRIX USING SELECTED STARTING VALUE AND POSITION IN MATRIX CORRESPONDING TO SOURCE IMAGE I," where an image processor (for example, the image processor 104 in FIG. 1) may initialize a block matrix (for example, the block matrix 302) using a selected start position (for example, the element $I_{11}$) and starting value as described above. The starting value may be a first row element or a first column element, and may be selected to be between zero and the value of the element at the selected start position, as described above.

Operation 922 may be followed by operation 924. "HORIZONTALLY EXTEND BLOCK MATRIX WITH ADDITIONAL HORIZONTAL DATA FROM SOURCE IMAGE I IF AVAILABLE," where the processor may extend the block matrix in a horizontal direction with additional elements from the source image (for example, the element $I_{12}$ in FIG. 3) to form an extended block matrix (for example, the block matrix 304), as described above.

Operation 924 may be followed by operation 926, "DETERMINE NEW APPROXIMATION IMAGE FACTOR BASED ON ADDITIONAL HORIZONTAL DATA AND EXISTING APPROXIMATION IMAGE DATA", where the processor may determine a new column factor based on the additional source image elements in the extended block matrix and any previously determined row factors. For example, referring to the extended block matrix 304, the processor may determine a new approximation image column factor $h_2$ using the equation $$h_2 = \frac{I_{12}}{w_1},$$

as described above.

Operation 926 may be followed by operation 928, "VERTICALLY EXTEND BLOCK MATRIX WITH ADDITIONAL VERTICAL DATA FROM SOURCE IMAGE I IF AVAILABLE", where the processor may extend the block matrix in a vertical direction with additional elements from the source image (for example, the elements $I_{21}$ and $I_{22}$ in FIG. 3) to form an extended block matrix (for example, the block matrix 306), as described above.

Operation 928 may be followed by operation 930, "DETERMINE NEW APPROXIMATION IMAGE FACTOR BASED ON ADDITIONAL VERTICAL DATA AND EXISTING APPROXIMATION IMAGE DATA", where the processor may determine a new row factor based on the additional source image elements in the extended block matrix and any previously-determined column factors. For example, referring to the extended block matrix 306, the processor may determine a new approximation image row factor $w_2$ may be by selecting the minimum value from the set $$\left\{\frac{I_{21}}{h_1}, \frac{I_{22}}{h_2}\right\},$$

as described above.

Operation 930 may be followed by operation 932, "REPEAT OPERATIONS 924-930 UNTIL NO ADDITIONAL HORIZONTAL OR VERTICAL DATA FROM SOURCE IMAGE I IS AVAILABLE", where the processor may repeat the operations 924-930 until all elements from the source image has been included in a block matrix and processed to generate row or column factors, as described above.

Figure 10:
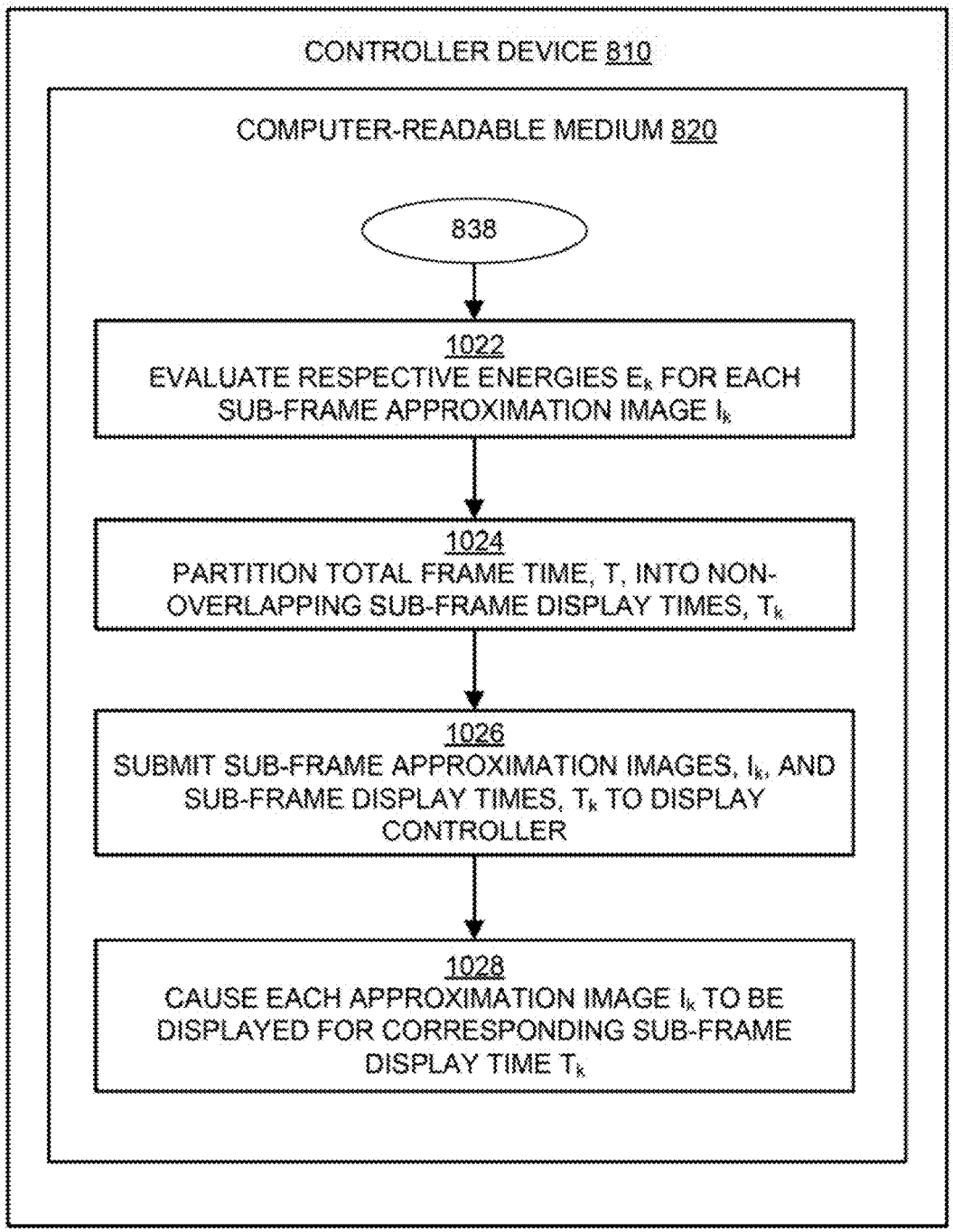
FIG. 10 is a flow diagram illustrating another example method for matrix factorization based image processing using approximation images following the completion of the iterative image processing shown in FIG. 8.

FIG. 10 is a flow diagram illustrating another example method for matrix factorization based image processing using approximation images following the completion of the iterative image processing shown in FIG. 8, arranged in accordance with at least some embodiments described herein.

The method may include one or more operations, functions, or actions as is illustrated by blocks 1022, 1024, 1026, and/or 1028. Instructions that enable the operations described in blocks 1022 through 1028 may also be stored as computer-executable instructions in a computer-readable medium 820 such as data storage devices 632 of the computing device 600 illustrated in FIG. 6 and executed by a controller device 810 such as processor 604 of computing device 600 of FIG. 6.

The process of FIG. 10 may follow operation 838 of FIG. 8 and begin with operation 1022, "EVALUATE RESPECTIVE ENERGIES $E_k$ FOR EACH SUB-FRAME APPROXIMATION IMAGE $I_k$." At operation 1022, an image processor (for example, the image processor 104 in FIG. 1) may evaluate respective energies $E_k$ (k=1, 2, . . . , K), for each sub-frame approximation image data $I_k$ (k=1, 2, . . . , K) by, for example, comparing the respective energies against a threshold as discussed above. Operation 1022 may be followed by operation 1024, "PARTITION TOTAL FRAME TIME, T, INTO NON-OVERLAPPING SUB-FRAME DISPLAY TIMES, $T_k$." At operation 1024, non-overlapping sub-frame display times $T_k$ (k=1, 2, . . . , K) may be computed by, for example, a sub-frame interval computation block such as the block 212 of FIG. 2 such that $E_1/T_1=E_2/T_2= \ldots =E_K/T_K$.

Operation 1024 may be followed by operation 1026, "SUBMIT SUB-FRAME APPROXIMATION IMAGES, $I_k$, AND SUB-FRAME DISPLAY TIMES, $T_k$, TO DISPLAY CONTROLLER." At operation 1026, the processor may send all sub-frame approximation image data $I_k$ (k=1, 2, . . . . , K) stored in a display buffer (for example, the display buffer 214) to a display device (for example, the display device 110) along with the sub-frame display times $T_k$ (k=1, 2, . . . , K) obtained from the sub-frame interval computation block.

Operation 1026 may be followed by operation 1028, "CAUSE EACH APPROXIMATION IMAGE, $I_k$, TO BE DISPLAYED FOR CORRESPONDING SUB-FRAME DISPLAY TIME, $T_k$." At operation 1028, a controller (for example, the controller 108 in FIG. 1) may display the individual approximation images through selective activation of multiple row drivers and multiple column drivers of the display device for corresponding sub-frame display times (e.g., $I_1$ for period $T_1$, $I_2$ for period $T_2$, . . . , $I_K$ for period $T_K$).

Figure 11:
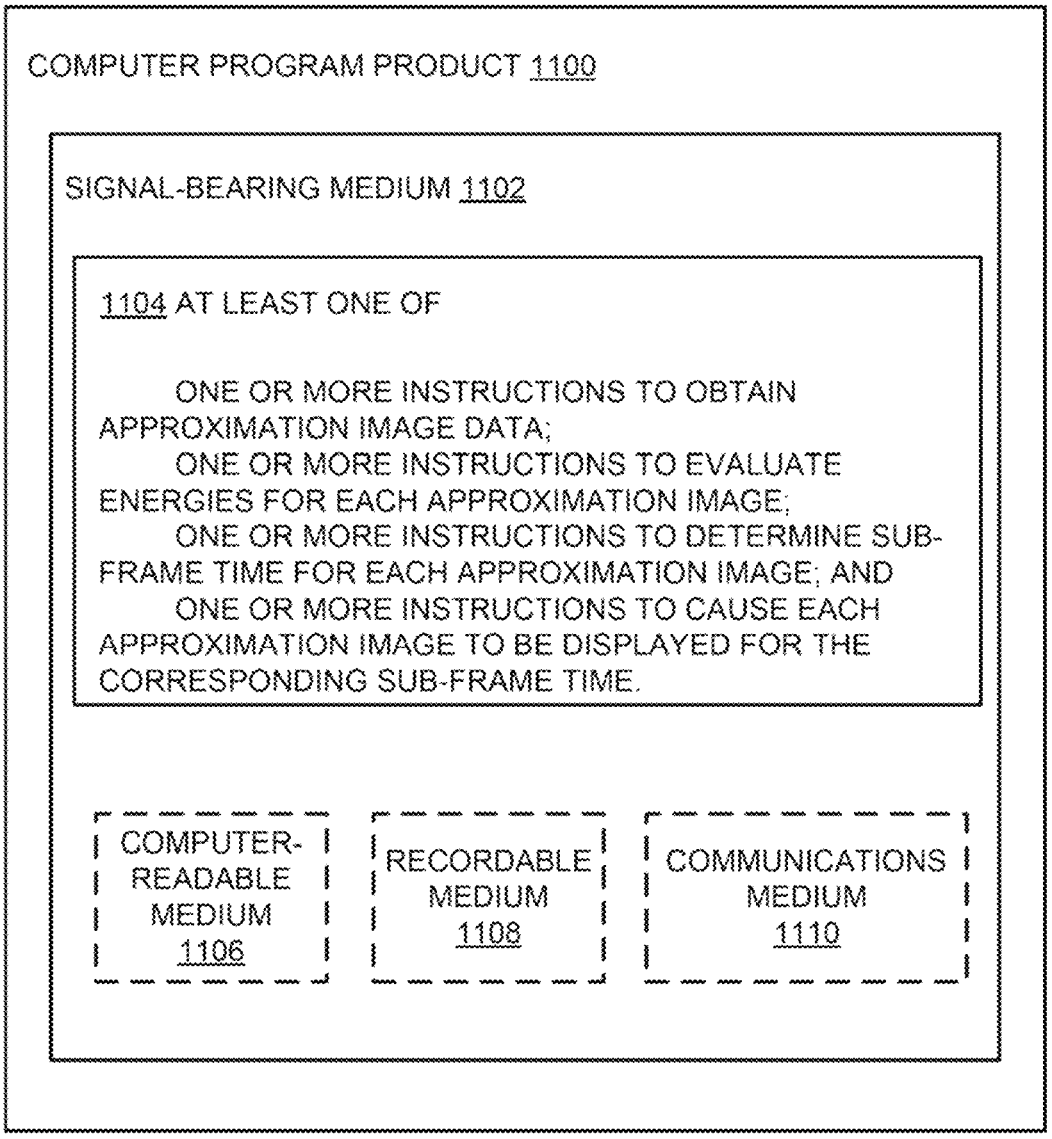
FIG. 11 illustrates a block diagram of an example computer program product, all arranged in accordance with at least some embodiments described herein.

FIG. 11 illustrates a block diagram of an example computer program product, arranged in accordance with at least some embodiments described herein.

In some examples, as shown in FIG. 11, a computer program product 1100 may include a signal bearing medium 1102 that may also include one or more machine readable instructions 1104 that, when executed by, for example, a processor may provide the functionality described herein. Thus, for example, referring to the processor 604 in FIG. 6, the image processing application 622 may undertake one or more of the tasks shown in FIG. 11 in response to the instructions 1104 being conveyed to the processor 604 by the signal bearing medium 1102 and executed by the processor 604 to perform or cause to be performed actions associated with convergent monotonic matrix factorization-based image processing as described herein. Some of those instructions may include, for example, instructions to obtain approximation image data, evaluate energies for each approximation image, determine sub-frame time for each approximation image, and/or cause each approximation image to be displayed for the corresponding sub-frame time, according to some embodiments described herein.

In some implementations, the signal bearing medium 1102 depicted in FIG. 11 may encompass computer-readable medium 1106, such as, but not limited to, a hard disk drive (HDD), a solid state drive (SSD), a compact disc (CD), a digital versatile disk (DVD), a digital tape, memory, etc. In some implementations, the signal bearing medium 1102 may encompass recordable medium 1108, such as, but not limited to, memory, read/write (R/W) CDs, R/W DVDs, etc. In some implementations, the signal bearing medium 1102 may encompass communications medium 1110, such as, but not limited to, a digital and/or an analog communication medium (e.g., a fiber optic cable, a waveguide, a wired communication link, a wireless communication link, etc.). Thus, for example, the computer program product 1100 may be conveyed to one or more modules of the processor 604 by an RF signal bearing medium, where the signal bearing medium 1102 is conveyed by the wireless communications medium 1110 (e.g., a wireless communication medium conforming with the IEEE 802.11 standard).

According to some examples, a method is described to generate drive signals for a display device to display a source image in response to receipt of source image data. The method may include applying a monotonic non-negative matrix factorization (NNMF) process to the source image data to generate approximation image data, partial sum image data, and residue image data. The monotonic NNMF process may include extending a block matrix selected from the source image data and determining at least one new factor based on the extended block matrix and one of an approximation image row vector and an approximation image column vector. The monotonic NNMF process may further include adding the at least one new factor to the other of the approximation image row vector and the approximation image column vector to form an extended approximation image vector and generating the residue image data based on the extended approximation image vector and one of the approximation image row vector and the approximation image column vector. The method may further include iteratively applying the monotonic NNMF process to the reside image data to generate subsequent approximation image data, subsequent partial sum image data, and subsequent residue image data until a specific criterion is satisfied, where each approximation image data corresponds to a sub-frame image. The method may further include partitioning a total frame time into one or more sub-frame times associated with each sub-frame image and sending, to the display device, the approximation image data and corresponding sub-frame time for each sub-frame image, where multiple row drivers and multiple column drivers of the display device are selectively activated based on the approximation image data and corresponding sub-frame time.

According to some embodiments, extending the block matrix may include including additional elements from the source image data to increase a height and/or a width of the block matrix. Determining the at least one new factor may include dividing a row or a column of the extended block matrix by the approximation image column vector or the approximation image row vector, respectively, to generate an intermediate result, and selecting a minimum value in the intermediate result as the at least one new factor such that the subsequent residue image data is non-negative. The monotonic NNMF process may further include selecting a direction to extend the block matrix, and determining the at least one new factor may include selecting the approximation image row vector or the approximation image column vector based on the selected direction. Selecting the direction may include alternately selecting a horizontal direction and a vertical direction and/or selecting a direction in which at least one unprocessed source image data element exists.

According to other embodiments, the monotonic NNMF process may further include selecting an initial position for the block matrix. The initial position may be selected from a corner position in the source image data, a random position in the source image data, or a midpoint position in the source image data. The specific criterion may include whether an energy and/or perceptual fidelity threshold has been reached, whether a time, buffer size, iteration, and/or frame count limitation has been reached, and/or whether the extended block matrix includes all of the source image data. The method may further include controlling the display device to express an average intensity of the display device for a time frame as a product of an average drive current ($I_D$) and a time ($t_D$) for which an output lead is grounded divided by the total frame time (T), $(I_D*t_D)/T$, where $0<t_D<T$ and $0<I_D<L$ may determine a range of the average intensity of the display device where the average drive current ($I_D$) being fed to the display device is controlled over a range of 0 units to L units.

According to further embodiments, iteratively applying the monotonic NNMF process may include obtaining first approximation image data and first partial sum image data, obtaining first residue image data by subtracting the first partial sum image data from the source image data, and obtaining second approximation image data by applying monotonic NNMF to the first residue image data. Iteratively applying the monotonic NNMF process may further include obtaining second partial sum image data by adding the second approximation image data to the first partial sum image data and obtaining second residue image data by subtracting the second partial sum image data from the source image data.

According to yet further embodiments, the one or more sub-frame times associated with each sub-frame image may correspond to an energy of the respective sub-frame image, and partitioning the total frame time into one or more sub-frame times associated with each sub-frame image may include partitioning the total frame time into one or more sub-frame times based on selecting the sub-frame times based on respective image energies and/or dividing the total frame time into equal portions. Sending the approximation image data and corresponding sub-frame times may include sending the approximation image data and corresponding sub-frame times to the display device for each color channel in a color display.

According to other examples, an apparatus to generate drive signals for a display device to display a source image in response to receipt of source image data. An example apparatus may include a memory configured to store instructions and source image data, a processor coupled to the memory and adapted to execute the instructions, which in response to execution configure the processor to perform or cause to be performed application of a monotonic non-negative matrix factorization (NNMF) process to the source image data to generate approximation image data, partial sum image data, and residue image data. The monotonic NNMF process may include extension of a block matrix selected from the source image data and determination of at least one new factor based on the extended block matrix and one of an approximation image row vector and an approximation image column vector. The monotonic NNMF process may further include addition of the at least one new factor to the other of the approximation image row vector and the approximation image column vector to form an extended approximation image vector and generation of the residue image data based on the extended approximation image vector and one of the approximation image row vector and the approximation image column vector. The processor may further perform or cause to be performed iterative application of the monotonic NNMF process to the reside image data to generate subsequent approximation image data, subsequent partial sum image data, and subsequent residue image data until a specific criterion is satisfied, where each approximation image data corresponds to a sub-frame image and may be buffered at a display buffer, and an energy of each sub-frame is determined partially from multiple activated pixels for a corresponding sub-frame. The processor may further perform or cause to be performed partition of a total frame time into one or more sub-frame times associated with each sub-frame image. The display buffer may be configured to send multiple buffered approximation image data for each sub-frame image to the display device such that multiple row drivers and multiple column drivers for the display devices are selectively activated for a duration based on a corresponding sub-frame time.

According to some embodiments, the processor may be configured to perform or cause to be performed the extension of the block matrix through an inclusion of additional elements from the source image data to increase a height or width of the block matrix. The processor may be configured to perform or cause to be performed the determination of the at least one new factor through a division of a row or a column of the extended block matrix by the approximation image column vector or the approximation image row vector, respectively. The monotonic NNMF process may further include selection of an initial position for the block matrix. The processor may be configured to perform or cause to be performed the selection of the initial position from a corner position in the source image data, a random position in the source image data, or a midpoint position in the source image data. The specific criterion may include whether an energy and/or fidelity threshold has been reached, whether a time, buffer size, iteration, and/or frame count limitation has been reached, and/or whether the extended block matrix includes all of the source image data.

According to other embodiments, the display buffer may be configured to send the multiple stored approximation image data for each sub-frame image to the display device such that all row drivers and all column drivers for the display device are selectively activated for the duration. During the application of the monotonic NNMF process, the processor may be configured to perform or cause to be performed obtain first approximation image data and first partial sum image data, obtain first residue image data through subtraction of the first partial sum image data from the source image data, and obtain second approximation image data through application of monotonic NNMF to the first residue image data. The processor may be further configured to obtain second partial sum image data through addition of the second approximation image data to the first partial sum image data and obtain second residue image data through subtraction of the second partial sum image data from the source image data. The display device may include organic light-emitting diode (OLED) based display arrays and elements of the display arrays may be addressed simultaneously.

According to further examples, a non-transitory computer-readable storage medium may store instructions to generate drive signals for a display device to display a source image in response to receipt of source image data. The instructions may include generating a separable non-negative matrix series representation (SNMSR) of the source image data by applying a monotonic non-negative matrix factorization (NNMF) process to the source image data to generate approximation image data, partial sum image data, and residue image data. The monotonic NNMF process may include extending a block matrix selected from the source image data and determining at least one new factor based on the extended block matrix and one of an approximation image row vector and an approximation image column vector. The monotonic NNMF process may further include adding the at least one new factor to the other of the approximation image row vector and the approximation image column vector to form an extended approximation image vector and generating the residue image data based on the extended approximation image vector and one of the approximation image row vector and the approximation image column vector. Generating the SNMSR may further include iteratively applying the monotonic NNMF process to the residue image data to generate subsequent approximation image data, subsequent partial sum image data, and subsequent residue image data, where each approximation image data corresponds to a sub-frame image. The instructions may further include truncating the SNMSR in response to satisfaction of a specific criterion, where an integration of the sub-frame images displayed over a complete frame interval effectively corresponds to the source image.

According to some embodiments, extending the block matrix may include including additional elements from the source image data to increase a height or a width of the block matrix, and determining the at least one new factor may include dividing a row or a height of the extended block matrix by the approximation image column vector or the approximation image row vector, respectively. The monotonic NNMF process may further include selecting an initial position for the block matrix from a corner position of the source image data, a random position in the source image data, and a midpoint position in the source image data. Each term in the SNMSR may include a unit rank image matrix arranged to contribute to an approximation of the source image. The complete frame interval may be partitioned into sub-frame times based on selecting the sub-frame times based on respective image energies, dividing the total frame time into equal portions, and/or a default partitioning scheme associated with a particular function.

Various embodiments may be implemented in hardware, software, or combination of both hardware and software (or other computer-readable instructions stored on a non-transitory computer-readable storage medium and executable by one or more processors); the use of hardware or software is generally (but not always, in that in certain contexts the choice between hardware and software may become significant) a design choice representing cost vs. efficiency tradeoffs. There are various vehicles by which processes and/or systems and/or other technologies described herein may be effected (e.g., hardware, software, and/or firmware), and the preferred vehicle will vary with the context in which the processes and/or systems and/or other technologies are deployed. For example, if an implementer determines that speed and accuracy are paramount, the implementer may opt for a mainly hardware and/or firmware vehicle; if flexibility is paramount, the implementer may opt for a mainly software implementation; or, yet again alternatively, the implementer may opt for some combination of hardware, software, and/or firmware.

The foregoing detailed description has set forth various embodiments of the devices and/or processes via the use of block diagrams, flowcharts, and/or examples. Insofar as such block diagrams, flowcharts, and/or examples contain one or more functions and/or operations, each function and/or operation within such block diagrams, flowcharts, or examples may be implemented, individually and/or collectively, by a wide range of hardware, software, firmware, or virtually any combination thereof. In one embodiment, several portions of the subject matter described herein may be implemented via application specific integrated circuits (ASICs), field programmable gate arrays (FPGAs), digital signal processors (DSPs), or other integrated formats. However, some aspects of the embodiments disclosed herein, in whole or in part, may be equivalently implemented in integrated circuits, as one or more computer programs executing on one or more computers (e.g., as one or more programs executing on one or more computer systems), as one or more programs executing on one or more processors (e.g., as one or more programs executing on one or more microprocessors), as firmware, or as virtually any combination thereof, and designing the circuitry and/or writing the code for the software and/or firmware are possible in light of this disclosure.

The present disclosure is not to be limited in terms of the particular embodiments described in this application, which are intended as illustrations of various aspects. Many modifications and variations can be made without departing from its spirit and scope. Functionally equivalent methods and apparatuses within the scope of the disclosure, in addition to those enumerated herein, are possible from the foregoing descriptions. Such modifications and variations are intended to fall within the scope of the appended claims. The present disclosure is to be limited only by the terms of the appended claims, along with the full scope of equivalents to which such claims are entitled. Also, the terminology used herein is for the purpose of describing particular embodiments only, and is not intended to be limiting.

In addition, the mechanisms of the subject matter described herein are capable of being distributed as a program product in a variety of forms, and that an illustrative embodiment of the subject matter described herein applies regardless of the particular type of signal bearing medium used to actually carry out the distribution. Examples of a signal bearing medium include, but are not limited to, the following: a recordable type medium such as a floppy disk, a hard disk drive (HDD), a compact disc (CD), a digital versatile disk (DVD), a digital tape, a computer memory, a solid state drive (SSD), etc.; and a transmission type medium such as a digital and/or an analog communication medium (e.g., a fiber optic cable, a waveguide, a wired communication link, a wireless communication link, etc.).

Those skilled in the art will recognize that it is common within the art to describe devices and/or processes in the fashion set forth herein, and thereafter use engineering practices to integrate such described devices and/or processes into data processing systems. That is, at least a portion of the devices and/or processes described herein may be integrated into a data processing system via a reasonable amount of experimentation. A data processing system may include one or more of a system unit housing, a video display device, a memory such as volatile and non-volatile memory, processors such as microprocessors and digital signal processors, computational entities such as operating systems, drivers, graphical user interfaces, and applications programs, one or more interaction devices, such as a touch pad or screen, and/or control systems including feedback loops and control motors (e.g., control motors to move and/or adjust components and/or quantities).

A data processing system may be implemented utilizing any suitable commercially available components, such as those found in data computing/communication and/or network computing/communication systems. The herein described subject matter sometimes illustrates different components contained within, or connected with, different other components. Such depicted architectures are merely exemplary, and in fact, many other architectures may be implemented which achieve the same functionality. In a conceptual sense, any arrangement of components to achieve the same functionality is effectively "associated" such that the desired functionality is achieved. Hence, any two components herein combined to achieve a particular functionality may be seen as "associated with" each other such that the desired functionality is achieved, irrespective of architectures or intermediate components. Likewise, any two components so associated may also be viewed as being "operably connected", or "operably coupled", to each other to achieve the desired functionality, and any two components capable of being so associated may also be viewed as being "operably couplable", to each other to achieve the desired functionality. Specific examples of operably couplable include but are not limited to physically connectable and/or physically interacting components and/or wirelessly interactable and/or wirelessly interacting components and/or logically interacting and/or logically interactable components.

With respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation, no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to embodiments containing only one such recitation, even when the same claim includes the introductory phrases "one or more" or "at least one" and indefinite articles such as "a" or "an" (e.g., "a" and/or "an" should be interpreted to mean "at least one" or "one or more"); the same holds true for the use of definite articles used to introduce claim recitations. In addition, even if a specific number of an introduced claim recitation is explicitly recited, those skilled in the art will recognize that such recitation should be interpreted to mean at least the recited number (e.g., the bare recitation of "two recitations," without other modifiers, means at least two recitations, or two or more recitations).

Furthermore, in those instances where a convention analogous to "at least one of A, B, and C, etc." is used, in general, such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

As will be understood by one skilled in the art, for any and all purposes, such as in terms of providing a written description, all ranges disclosed herein also encompass any and all possible subranges and combinations of subranges thereof. Any listed range can be easily recognized as sufficiently describing and enabling the same range being broken down into at least equal halves, thirds, quarters, fifths, tenths, etc. As a non-limiting example, each range discussed herein can be readily broken down into a lower third, middle third and upper third, etc. As will also be understood by one skilled in the art all language such as "up to," "at least," "greater than," "less than," and the like include the number recited and refer to ranges which can be subsequently broken down into subranges as discussed above. Finally, as will be understood by one skilled in the art, a range includes each individual member. Thus, for example, a group having 1-3 cells refers to groups having 1, 2, or 3 cells. Similarly, a group having 1-5 cells refers to groups having 1, 2, 3, 4, or 5 cells, and so forth.

While various aspects and embodiments have been disclosed herein, other aspects and embodiments are possible. The various aspects and embodiments disclosed herein are for purposes of illustration and are not intended to be limiting, with the true scope and spirit being indicated by the following claims.

What is claimed is:

1. A method, by an image processor, to generate drive signals for a display device to display a source image in response to receipt of source image data, the method comprising:

applying a monotonic non-negative matrix factorization (NNMF) process to the source image data to generate approximation image data, partial sum image data, and residue image data, wherein applying the monotonic NNMF process comprises:

extending a block matrix that is selected from the source image data:

determining at least one new factor based on:

the extended block matrix; and one of an approximation image row vector and an approximation image column vector, wherein determining the at least one new factor comprises:

dividing one of a row of the extended block matrix and a column of the extended block matrix by the approximation image column vector or the approximation image row vector, respectively, to generate an intermediate result; and selecting a minimum value in the intermediate result as the at least one new factor such that subsequent residue image data is non-negative;

adding the at least one new factor to the other of the approximation image row vector and the approximation image column vector to form an extended approximation image vector; and generating the residue image data based on the extended approximation image vector and one of the approximation image row vector and the approximation image column vector;

iteratively applying the monotonic NNMF process to the residue image data to generate subsequent approximation image data, subsequent partial sum image data, and subsequent residue image data until a specific criterion is satisfied, wherein each approximation image data corresponds to a sub-frame image;

partitioning a total frame time into one or more sub-frame times associated with each sub-frame image; and sending, to the display device, the approximation image data and corresponding sub-frame time for each sub-frame image, wherein multiple row drivers and multiple column drivers of the display device are selectively activated based on the approximation image data and the corresponding sub-frame time.

2. The method of claim 1, wherein extending the block matrix comprises including additional elements from the source image data to increase one or both of a height of the block matrix and a width of the block matrix.

3. The method of claim 1, wherein:

applying the monotonic NNMF process further comprises selecting a direction to extend the block matrix, and determining the at least one new factor comprises selecting one of the approximation image row vector and the approximation image column vector based on the selected direction.

4. The method of claim 3, wherein selecting the direction comprises at least one of:

alternately selecting a horizontal direction and a vertical direction; and selecting a direction in which at least one unprocessed source image data element exists.

5. The method of claim 1, wherein applying the monotonic NNMF process further comprises selecting an initial position for the block matrix.

6. The method of claim 5, wherein selecting the initial position includes selecting one of a corner position in the source image data, a random position in the source image data, and a midpoint position in the source image data.

7. The method of claim 1, wherein iteratively applying the monotonic NNMF process comprises:

obtaining first approximation image data and first partial sum image data;

obtaining first residue image data by subtracting the first partial sum image data from the source image data; and obtaining second approximation image data by applying the monotonic NNMF process to the first residue image data.

8. The method of claim 7, wherein iteratively applying the monotonic NNMF process further comprises:

obtaining second partial sum image data by adding the second approximation image data to the first approximation image data; and obtaining second residue image data by subtracting the second partial sum image data from the source image data.

9. The method of claim 1, wherein:

the one or more sub-frame times associated with each sub-frame image correspond to an energy of the sub-frame image, and partitioning the total frame time into the one or more sub-frame times associated with each sub-frame image comprises partitioning the total frame time into the one or more sub-frame times based on one or more of:

selecting the one or more sub-frame times based on respective image energies; and dividing the total frame time into equal portions.

10. An apparatus to generate drive signals for a display device to display a source image in response to receipt of source image data, the apparatus comprising:

a display buffer;

a memory configured to store instructions and source image data; and a processor coupled to the memory and to the display buffer, wherein the processor is adapted to execute the instructions, which in response to execution, configure the processor to perform or cause to be performed:

application of a monotonic non-negative matrix factorization (NNMF) process to the source image data to generate approximation image data, partial sum image data, and residue image data, wherein the application of the monotonic NNMF process comprises:

extension of a block matrix to form an extended block matrix, wherein the block matrix is selected from the source image data;

determination of at least one new factor based on:

the extended block matrix; and one of an approximation image row vector and an approximation image column vector, wherein determination of the at least one new factor comprises:

division of one of a row of the extended block matrix and a column of the extended block matrix by the approximation image column vector or the approximation image row vector, respectively, to generate an intermediate result: and selection of a minimum value in the intermediate result as the at least one new factor such that subsequent residue image data is non-negative;

addition of the at least one new factor to the other of the approximation image row vector and the approximation image column vector to form an extended approximation image vector; and generation of the residue image data based on the extended approximation image vector and one of the approximation image row vector and the approximation image column vector;

iterative application of the monotonic NNMF process to the residue image data to generate subsequent approximation image data, subsequent partial sum image data, and subsequent residue image data until a specific criterion is satisfied, wherein each approximation image data corresponds to a sub-frame image and is buffered at the display buffer, and wherein an energy of each sub-frame image is determined partially from a plurality of activated pixels for a corresponding sub-frame; and partition of a total frame time into one or more sub-frame times associated with each sub-frame image, wherein the display buffer is configured to send a plurality of buffered approximation image data for each sub-frame image to the display device such that multiple row drivers and multiple column drivers of the display device are selectively activated for a duration based on a corresponding sub-frame time.

11. The apparatus of claim 10, wherein the processor is configured to perform or cause to be performed the extension of the block matrix through an inclusion of additional elements from the source image data to increase one or both of a height of the block matrix and a width of the block matrix.

12. The apparatus of claim 10, wherein the specific criterion includes at least one of:

whether an energy fidelity threshold has been reached;

whether a perceptual fidelity threshold has been reached;

whether a time limitation has been reached;

whether a buffer size limitation has been reached;

whether an iteration limitation has been reached;

whether a frame count limitation has been reached; and whether the extended block matrix includes all of the source image data.

13. The apparatus of claim 10, wherein the display buffer is configured to send the plurality of buffered approximation image data for each sub-frame image to the display device such that all row drivers and all column drivers of the display device are selectively activated for the duration.

14. The apparatus of claim 10, wherein during the application of the monotonic NNMF process, the processor is configured to perform or cause to be performed:

obtain first approximation image data and first partial sum image data;

obtain first residue image data by subtraction of the first partial sum image data from the source image data;

obtain second approximation image data by application of the monotonic NNMF process to the first residue image data;

obtain second partial sum image data by addition of the second approximation image data to the first approximation image data; and obtain second residue image data by subtraction of the second partial sum image data from the source image data.

15. The apparatus of claim 10, wherein:

the display device comprises organic light-emitting diode (OLED) based display arrays, and elements of the OLED based display arrays are addressed simultaneously.

16. A non-transitory computer-readable storage medium that includes instructions stored thereon to generate drive signals for a display device to display a source image in response to receipt of source image data, wherein the instructions are executable by a processor to enable the processor to perform or cause to be performed operations comprising:

generate a separable non-negative matrix series representation (SNMSR) of the source image data by:

application of a monotonic non-negative matrix factorization (NNMF) process to the source image data to generate approximation image data, partial sum image data, and residue image data, wherein the application of the monotonic NNMF process comprises:

extension of a block matrix that is selected from the source image data;

determination of at least one new factor based on:

the extended block matrix; and one of an approximation image row vector and an approximation image column vector, wherein determination of the at least one new factor comprises:

division of one of a row of the extended block matrix and a column of the extended block matrix by the approximation image column vector or the approximation image row vector, respectively, to generate an intermediate result; and selection of a minimum value in the intermediate result as the at least one new factor such that subsequent residue image data is non-negative;

addition of the at least one new factor to the other of the approximation image row vector and the approximation image column vector to form an extended approximation image vector; and generation of the residue image data based on the extended approximation image vector and one of the approximation image row vector and the approximation image column vector;

iteratively apply the monotonic NNMF process to the residue image data to generate subsequent approximation image data, subsequent partial sum image data, and subsequent residue image data, wherein each approximation image data corresponds to a sub-frame image; and truncate the SNMSR in response to satisfaction of a particular criterion, wherein an integration of the sub-frame images displayed over a complete frame interval effectively corresponds to the source image.

17. The non-transitory computer-readable storage medium according to claim 16, wherein:

the extension of the block matrix comprises inclusion of additional elements from the source image data to increase one or both of a height of the block matrix and a width of the block matrix, and the determination of the at least one new factor comprises division of one of a row of the extended block matrix and a height of the extended block matrix by the approximation image column vector or the approximation image row vector, respectively.

18. The non-transitory computer-readable storage medium according to claim 16, wherein the application of the monotonic NNMF process further comprises selection of an initial position for the block matrix from one of a corner position in the source image data, a random position in the source image data, and a midpoint position in the source image data.

19. The non-transitory computer-readable storage medium according to claim 16, wherein each term in the SNMSR includes a unit rank image matrix arranged to contribute to an approximation of the source image.

20. A method, by an image processor, to generate drive signals for a display device to display a source image in response to receipt of source image data, the method comprising:

applying a monotonic non-negative matrix factorization (NNMF) process to the source image data to generate approximation image data, partial sum image data, and residue image data, wherein applying the, monotonic NNMF process comprises:

extending a block matrix that is selected from the source image data;

determining at least one new factor based on:

the extended block matrix; and one of an approximation image row vector and an approximation image column vector;

adding the at least one new factor to the other of the approximation image row vector and the approximation image column vector to form an extended approximation image vector; and generating the residue image data based on the extended approximation image vector and one of the approximation image row vector and the approximation image column vector, wherein the monotonic NNMF process further comprises selecting a direction to extend the block matrix, and wherein determining the at least one new factor comprises selecting one of the approximation image row vector and the approximation image column vector based on the selected direction;

iteratively applying the monotonic NNMF process to the residue image data to generate subsequent approximation image data, subsequent partial sum image data. and subsequent residue image data until a specific criterion is satisfied, wherein each approximation image data corresponds to a sub-frame image;

partitioning a total frame time into one or mere sub-frame times associated with each sub-frame image; and sending, to the display device, the approximation image data and corresponding sub- frame time for each sub-frame image, wherein multiple row drivers and multiple column drivers of the display device are selectively activated based on the approximation image data and the corresponding sub-frame time.

21. The method of claim 20, wherein selecting the direction to extend the block matrix comprises alternately selecting a horizontal direction and a vertical direction.

* * * * *